US005396576A

United States Patent [19]

Miki et al.

[11] Patent Number: 5,396,576

[45] Date of Patent: Mar. 7, 1995

[54] SPEECH CODING AND DECODING METHODS USING ADAPTIVE AND RANDOM CODE BOOKS

[75] Inventors: Satoshi Miki; Takehiro Moriya, both of Tokorozawa; Kazunori Mano, Tokyo; Hitoshi Ohmuro, Higashimurayama; Hirohito Suda, Yokosuka, all of Japan

[73] Assignee: Nippon Telegraph and Telephone Corporation, Tokyo, Japan

[21] Appl. No.: 886,013

[22] Filed: May 20, 1992

[30] Foreign Application Priority Data

| | | | |
|---|---|---|---|
| May 22, 1991 | [JP] | Japan | 3-117646 |
| Jul. 4, 1991 | [JP] | Japan | 3-164263 |
| Jul. 8, 1991 | [JP] | Japan | 3-167078 |
| Jul. 8, 1991 | [JP] | Japan | 3-167081 |
| Jul. 8, 1991 | [JP] | Japan | 3-167124 |
| Oct. 7, 1991 | [JP] | Japan | 3-258936 |
| Oct. 22, 1991 | [JP] | Japan | 3-272985 |

[51] Int. Cl.[6] ..... G10L 9/00

[52] U.S. Cl. ..... 395/2.31; 395/2.3

[58] Field of Search ..... 395/2.28, 2.29, 2.3, 395/2.31, 2.32; 381/29–38

[56] References Cited

U.S. PATENT DOCUMENTS

| | | | |
|---|---|---|---|
| 4,817,157 | 3/1989 | Gerson | 381/40 |
| 5,119,423 | 6/1992 | Shiraki et al. | 395/2.28 |
| 5,195,137 | 3/1993 | Swaminathan | 381/29 |

FOREIGN PATENT DOCUMENTS

| | | |
|---|---|---|
| 0296764 | 12/1988 | European Pat. Off. . |
| 0462559 | 12/1991 | European Pat. Off. . |

*Primary Examiner*—Allen R. MacDonald
*Assistant Examiner*—Michelle Doerrler
*Attorney, Agent, or Firm*—Pollock, VandeSande and Priddy

[57] ABSTRACT

An excitation vector of the previous frame stored in an adaptive codebook is cut out with a selected pitch period. The excitation vector thus cut out is repeated until one frame is formed, by which a periodic component codevector is generated. An optimum pitch period is searched for so that distortion of a reconstructed speech obtained by exciting a linear predictive synthesis filter with the periodic component codevector is minimized. Thereafter, a random codevector selected from a random codebook is cut out with the optimum pitch period and is repeated until one frame is formed, by which a repetitious random codevector is generated. The random codebook is searched for a random codevector which minimizes the distortion of the reconstructed speech which is provided by exciting the synthesis filter with the repetitious random codevector.

27 Claims, 31 Drawing Sheets

ADAP CB
16
L
1
2
N1
17₁
RAND CB
ADAP CODE VEC
L
L
REPETITIOUS CODE VEC
N2
17₂
RAND CB
NON-REPETITIOUS CODE VEC
FRAME
21₀
g₀
21₁
g₁
21₂
g₂
C₁
C₂
WEIGHT GEN
23
G
22
E
LP SYN FIL
15
A
X" RECONSTRUCTED SPEECH

E
L
16
ADAP CB
RAND CB
17
C
L
L/2
39
36
37
38
41
21₀
g₀
21₁
g₁
22
E
A
15
SYN FIL
X'

LARGE $\gamma$

SMALL $\gamma$

FIG. 29

| | NUMBER OF CHANNELS:K | NUMBER OF VECTORS IN EACH CHANNEL:N | TOTAL NUMBER OF VECTORS:S |
|---|---|---|---|
| CELP | 1 | $2^{B-1}$ | $2^{B-1}$ |
| FIG. 28 | 2 | $2^{B/2-1}$ | $2^{B/2}$ |
| | 4 | $2^{B/4-1}$ | $2^{B/4}$ |
| | ⋮ | ⋮ | ⋮ |
| VSELP | B | 1 | B |

FIG. 34A

| $V_i$ \ $V'_i$ | $V'_0$ | $V'_1$ | ----- | $V'_{M-1}$ |
|---|---|---|---|---|
| $V_0$ | $f_{0,0}$ | $f_{1,0}$ | ----- | $f_{M-1,0}$ |
| $V_1$ | $f_{0,1}$ | $f_{1,1}$ | ----- | $f_{M-1,1}$ |
| ⋮ | ⋮ | ⋮ | | ⋮ |
| $V_{M-1}$ | $f_{0,M-1}$ | $f_{1,M-1}$ | ----- | $f_{M-1,M-1}$ |
| $V_M$ | $f_{0,M}$ | $f_{1,M}$ | ----- | $f_{M-1,M}$ |

FIG. 34B

| $V_i$ \ $V'_i$ | $V'_0$ | $V'_1$ | ------- | $V'_{M-1}$ |
|---|---|---|---|---|
| $V_0$ | $g_0$ | 0 | ------- | 0 |
| $V_1$ | 0 | 0 | ------- | 0 |
| ⋮ | ⋮ | ⋮ | | ⋮ |
| $V_{M-1}$ | 0 | 0 | ------- | 0 |
| $V_M$ | $g_M$ | 0 | ------- | 0 |

FIG. 35A

| $V_i$ \ $V'_i$ | $V'_0$ | $V'_1$ | $V'_2$ | ----- | $V'_{M-1}$ |
|---|---|---|---|---|---|
| $V_0$ | $g_0$ | 0 | 0 | ----- | 0 |
| $V_1$ | $g_1$ | 0 | 0 | ----- | 0 |
| $V_2$ | 0 | 0 | 0 | ----- | 0 |
| ⋮ | ⋮ | ⋮ | ⋮ | | ⋮ |
| $V_{M-1}$ | 0 | 0 | 0 | ----- | 0 |
| $V_M$ | $g_M$ | $g_M$ | 0 | ----- | 0 |

FIG. 35B

| $V_i$ \ $V'_i$ | $V'_0$ | $V'_1$ | $V'_2$ | -------- | $V'_{M-2}$ | $V'_{M-1}$ |
|---|---|---|---|---|---|---|
| $V_0$ | 0 | ---------- | ---------- | ---------- | 0 | 0 |
| $V_1$ | $g_1$ | | ⋮ | ⋮ | ⋮ | ⋮ |
| $V_2$ | 0 | $g_2$ | | ⋮ | ⋮ | ⋮ |
| ⋮ | ⋮ | ⋮ | | | ⋮ | ⋮ |
| $V_{M-2}$ | ⋮ | ⋮ | ⋮ | | 0 | ⋮ |
| $V_{M-1}$ | 0 | ---------- | ---------- | 0 | $g_{M-1}$ | 0 |
| $V_M$ | 0 | ---------- | ---------- | ---------- | 0 | $g_M$ |

SPEECH CODING AND DECODING METHODS USING ADAPTIVE AND RANDOM CODE BOOKS

BACKGROUND OF THE INVENTION

The present invention relates to a high efficiency speech coding method which employs a random codebook and is applied to Code-Excited Linear Prediction (CELP) coding or Vector Sum Excited Linear Prediction (VSELP) coding to encode a speech signal to digital codes with a small amount of information. The invention also pertains to a decoding method for such a digital code.

At present, there is proposed a high efficiency speech coding method wherein the original speech is divided into equal intervals of 5 to 50 msec periods called frames, the speech of one frame is separated into two pieces of information, one being the envelope configuration of its frequency spectrum and the other an excitation signal for driving a linear filter corresponding to the envelope configuration, and these pieces of information are encoded. A known method for coding the excitation signal is to separate the excitation signal into a periodic component considered to correspond to the fundamental frequency (or pitch period) of the speech and the other component (in other words, an aperiodic component) and encode them. Conventional excitation signal coding methods are known under the names of Code-Excited Linear Prediction (CELP) coding and Vector Sum Excited Linear Prediction (VSELP) coding methods. Their techniques are described in M. R. Schroeder and B. S. Atal: "Code-Excited Linear Prediction (CELP); High-Quality Speech at Very Low Bit Rates," Proc. ICASSP '85, 25. 1. 1, pp. 937–940, 1985, and I. A. Gerson and M. A. Jusiuk: "Vector Sum Excited Linear Prediction (VSELP) Speech Coding at 8 kbps," Proc. ICASSP '90, S9.3, pp. 461–464, 1990.

According to these coding methods, as shown in FIG. 1, the original speech X input to an input terminal 11 is provided to a speech analysis part 12, wherein a parameter representing the envelope configuration of this frequency spectrum is calculated. A linear predictive coding (LPC) method is usually employed for the analysis. The LPC parameters thus obtained are encoded by a LPC parameter encoding part 13, the encoded output A of which is decoded by LPC parameter decoding part 14, and the decoded LPC parameters a' are set as the filter coefficients of a LPC synthesis filter 15. By applying an excitation signal (an excitation vector) E to the LPC synthesis filter 15, a reconstructed speech X' is obtained.

In an adaptive codebook 16 there is always held a determined excitation vector of the immediately preceding frame. A segment of a length L corresponding to a certain period (a pitch period) is cut out from the excitation vector and the vector segment thus cut out is repeatedly concatenated until the length T of one frame is reached, by which a codevector corresponding to the periodic component of the speech is output. By changing the cut-out length L which is provided as a period code (indicated by the same reference character L as that for the cut-out length) to the adaptive codebook 16, it is possible to output a codevector corresponding to the different period. In the following description the codevector which is output from the adaptive codebook will be referred to as an adaptive codevector.

While one or a desired number of random codebooks are provided, the following description will be given of the case where two random codebooks $\mathbf{17}_1$ and $\mathbf{17}_2$ are provided. As indicated by reference numeral 17 in FIG. 2 as a representative of either random codebook $\mathbf{17}_1$ or $\mathbf{17}_2$, there are prestored in the random codebooks $\mathbf{17}_1$ or $\mathbf{17}_2$, independently of the input speech, various vectors usually based on a white Gaussian noise and having the length T of one frame. From the random codebooks the stored vectors specified by given random codes C ($C_1$, $C_2$) are read out and output as codevectors corresponding to aperiodic components of the speech. In the following description the codevectors output from the random codebooks will be referred to as random codevectors.

The codevectors from the adaptive codebook 16 and the random codebooks $\mathbf{17}_1$ or $\mathbf{17}_2$ are provided to a weighted accumulation part 20, wherein they are multiplied, in multiplication parts $\mathbf{21}_0$, $\mathbf{21}_1$ and $\mathbf{21}_2$, by weights (i.e., gains) $g_0$, $g_1$ and $g_2$ from a weight generation part 23, respectively, and the multiplied outputs are added together in an addition part 22. The weight generation part 23 generates the weights $g_0$, $g_1$ and $g_2$ in accordance with a weight code G provided thereto. The added output from the addition part 22 is supplied as an excitation vector candidate to the LPC synthesis filter 15, from which the synthesized speech X' is output. A distortion d of the synthesized speech X', with respect to the original speech X from the input terminal 11, is calculated in a distance calculation part 18.

Based on a criterion for minimizing the distortion d, a codebook search control part 19 searches for a most suitable cut-out length L in the adaptive codebook 16 to determine an optimal codevector of the adaptive codebook 16. Then, the codebook search control part 19 determine sequentially optimal codevectors of the random codebooks $\mathbf{17}_1$ and $\mathbf{17}_2$ and optimal weights $g_0$, $g_1$ and $g_2$ of the weighted accumulation part 20. In this way, a combination of codes is searched which minimizes the distortion d, and the excitation vector candidate at that time is determined as an excitation vector E for the current frame and is written into the adaptive codebook 16. When the distortion is minimized, the period code L representative of the cut-out length of the adaptive codebook 16, the random codes $C_1$ and $C_2$ representative of code vectors of the random codebooks $\mathbf{17}_1$ and $\mathbf{17}_2$, a weight code G representative of the weights $g_0$, $g_1$ and $g_2$, and a LPC parameter code A are provided as coded outputs and transmitted or stored.

FIG. 3 shows a decoding method. The input LPC parameter code A is decoded in a LPC parameter decoding part 26 and the decoded LPC parameters a' are set as filter coefficients in a LPC synthesis filter 27. A vector segment of a period length L of the input period code L is cut out of an excitation vector of the immediately preceding frame stored in an adaptive codebook 28 and the thus cut-out vector segment is repeatedly concatenated until the frame length T is reached, whereby a codevector is produced. On the other hand, codevectors corresponding to the input random codes $C_1$ and $C_2$ are read out of random codebooks $\mathbf{29}_1$ and $\mathbf{29}_2$, respectively, and a weight generation part 32 of a weighted accumulation part 30 generates the weights $g_0$, $g_1$ and $g_2$ in accordance with the input weight code G. These output code vectors are provided to multiplication parts $\mathbf{31}_0$, $\mathbf{31}_1$ and $\mathbf{31}_2$, wherein they are multiplied by the weights $g_0$, $g_1$ and $g_2$ from the weight generation part 32 and then added together in an addition part 33. The added output is supplied as a new excitation vector E to the LPC synthesis filter 27, from which a reconstructed speech X' is obtained.

The random codebooks $29_1$ and $29_2$ are identical with those $17_1$ and $17_2$ used for encoding. As referred to previously, only one or more than one random codebooks may sometimes be employed. In the CELP speech coding, codevectors to be selected as optimal codevectors are directly prestored in the random codebooks $17_1$, $17_2$ and $29_1$, $29_2$ in FIGS. 1 and 3. That is, when the number of codevectors to be selected as optimal code vectors is N, the number of vectors stored in each random codebook is also N.

In the VSELP speech coding, the random codebooks $17_1$ and $17_2$ in FIG. 1 are replaced by a random codebook 27 shown in FIG. 4, in which M vector (referred to as basis vectors in the case of VSELP coding) stored in a basis vector table 25 are simultaneously read out, they are provided to multiplication parts $34_1$ to $34_M$, wherein they are multiplied by $+1$ or $-1$ by the output of a random codebook decoder 24, and the multiplied outputs are added together in an addition part 35, thereafter being output as a codevector. Accordingly, the number of different code vectors obtainable with all combinations of the signal values $+1$ and $-1$, by which the respective basis vectors are multiplied, is $2^M$, one of the $2^M$ codevectors is chosen so that the distortion d is minimized, and the code C (M bits) indicating a combination of signs which provides the chosen codevector is determined.

There are two methods for determining the weights $g_0$, $g_1$ and $g_2$, which are used in the weighted accumulation part 20 in FIG. 1; a method in which weights are scalar quantized, which are theoretically optimal so that the distortion is minimized during the search for a period (i.e., the search for the optimal cut-out length L of the adaptive codebook 16) and during search for a random code vector (i.e., the search for the random codebooks $17_1$ and $17_2$), and a method in which a weight codebook is searched, which has prestored therein, as weight vectors, a plurality of sets of weights $g_0$, $g_1$ and $g_2$, the weight vector ($g_0$, $g_1$ and $g_2$) is determined to minimize the distortion.

With the conventional methods described above, since the periodicity of the excitation signal is limited only to the component of the preceding frame, the periodicity is not clearly expressed and hence the reconstructed speech is hoarse and lacks smoothness.

SUMMARY OF THE INVENTION

It is therefore an object of the present invention to provide a method which permits clear expression of the periodicity of the excitation signal conventionally represented by only the period component concerning the preceding frame, thereby enabling the reconstructed speech to be expressed more smoothly and more accurately.

According to the present invention, to clearly express the periodicity of a speech, a part or whole of the random codevector which is output from a random codebook, a part of the component of the output random codevector, or a part of a plurality of random codebooks, which has no periodicity in the prior art, is provided with periodicity related to that of the output vector of the adaptive codebook.

BRIEF DESCRIPTION OF THE DRAWINGS

FIG. 29 is a table showing the relationship between the number of channels of random codebooks and the total number of vectors;

FIG. 34A is a diagram showing general relationships of weight $f_{00}$ to $f_{M-1,M}$ which are provided to adaptive codevectors $V_0$ to $V_{M-1}$ and random codevector $V_M$ at the time of updating the adaptive codebook;

FIG. 34B is a diagram showing examples of the weights $F_{00}$ to $f_{M-1,M}$ in FIG. 34A;

FIG. 35A is a diagram showing concrete examples of the weights $f_{00}$ to $f_{M-1,M}$;

FIG. 35B is a diagram showing other concrete examples of the weights $f_{00}$ to $f_{M-1,M}$.

DESCRIPTION OF THE PREFERRED EMBODIMENTS

Embodiment 1

Figure 5:
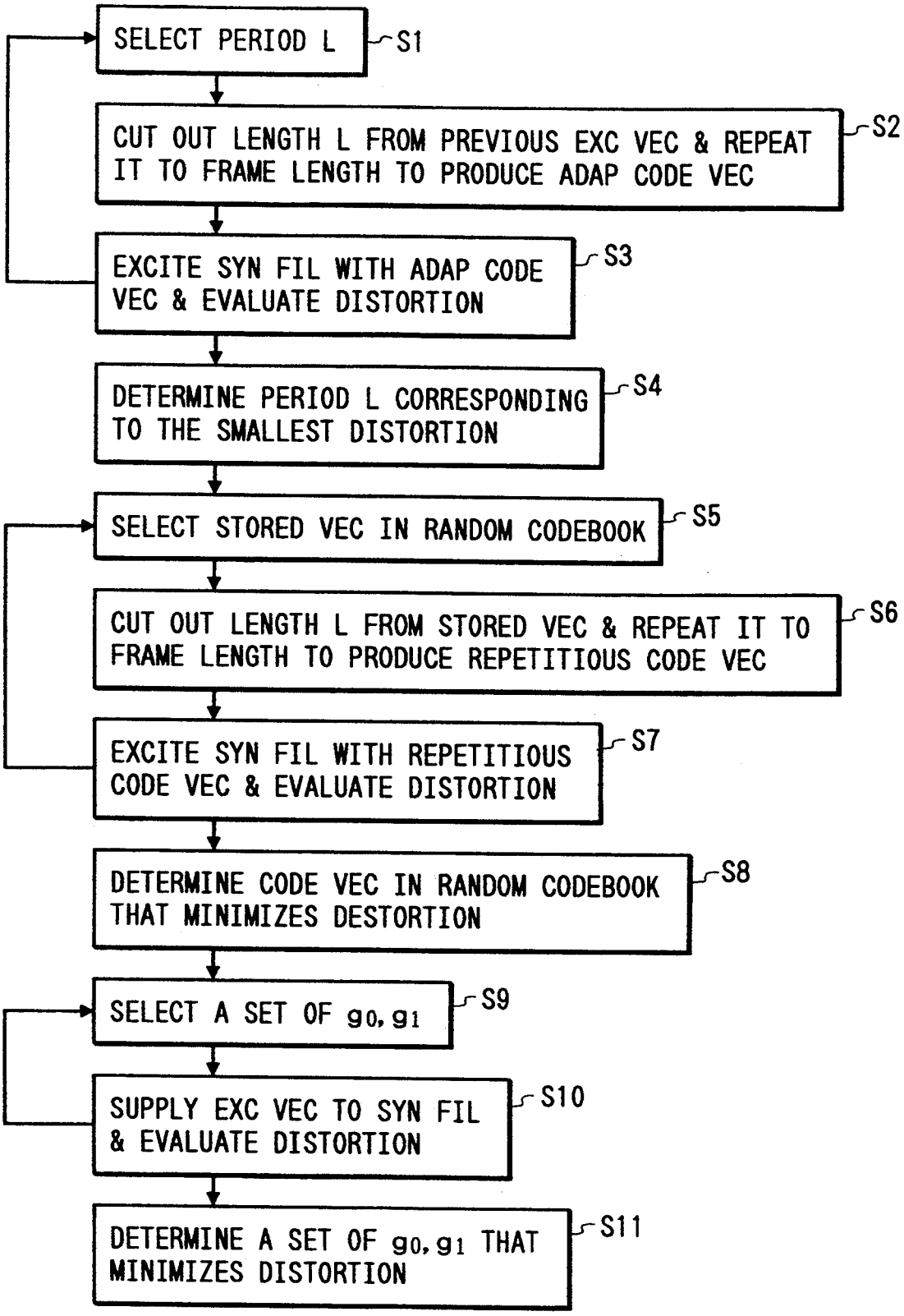
FIG. 5 is a flowchart for explaining a speech coding method by a first embodiment of the present invention.

FIG. 5 shows a coding procedure in the case where the speech coding method according to the present invention is applied to a coding part in the CELP coding. The coding procedure will be described with reference to FIGS. 1 and 6. The conceptual construction of the encoder employed in this case is identical with that shown in FIG. 1. In this case, assume that only one random codebook is used, the codebook being identified by reference numeral 17. Now, suppose that the LPC synthesis filter 15 has set therein from the LPC parameter decoding part 14, as its filter coefficients, the LPC parameters a' corresponding to that obtained by analyzing in the speech analysis part 12 the input speech frame (a vector composed of a predetermined number of samples) to be encoded. Further, assume that the vector X of the speech frame (the input speech vector) is provided as an object for comparison to the distance calculation part 18.

As is the case with the prior art, the coding procedure begins with selecting one of a plurality of periods L within the range of a predetermined pitch period (the range over which an ordinary pitch period exists) in step S1. In step S2 a vector segment of the length of the selected period L is cut out from the excitation vector E of the preceding frame in the adaptive codebook 16 and the same vector segment is repeatedly concatenated until a predetermined frame length is reached, by which a codevector of the adaptive codebook is obtained.

Next, in step S3 the codevector of the adaptive codebook is provided to the LPC synthesis filter 15 to excite it, and its output (a reconstructed speech vector) X' is provided to the distance calculation part 18, wherein the distance to the input vector, i.e. the distortion is calculated.

The process returns to step S1, wherein another period L is selected and in steps S2 and S3 the distortion is calculated by the same procedure as mentioned above. This processing is repeated for all the periods L.

In step S4 the period L (and the period code L) which provided a minimum one of the distortions and the corresponding codevector of the adaptive codebook are determined.

In step S5 one stored vector is selected, i.e. read out from the random codebook $17_1$.

Figure 6:
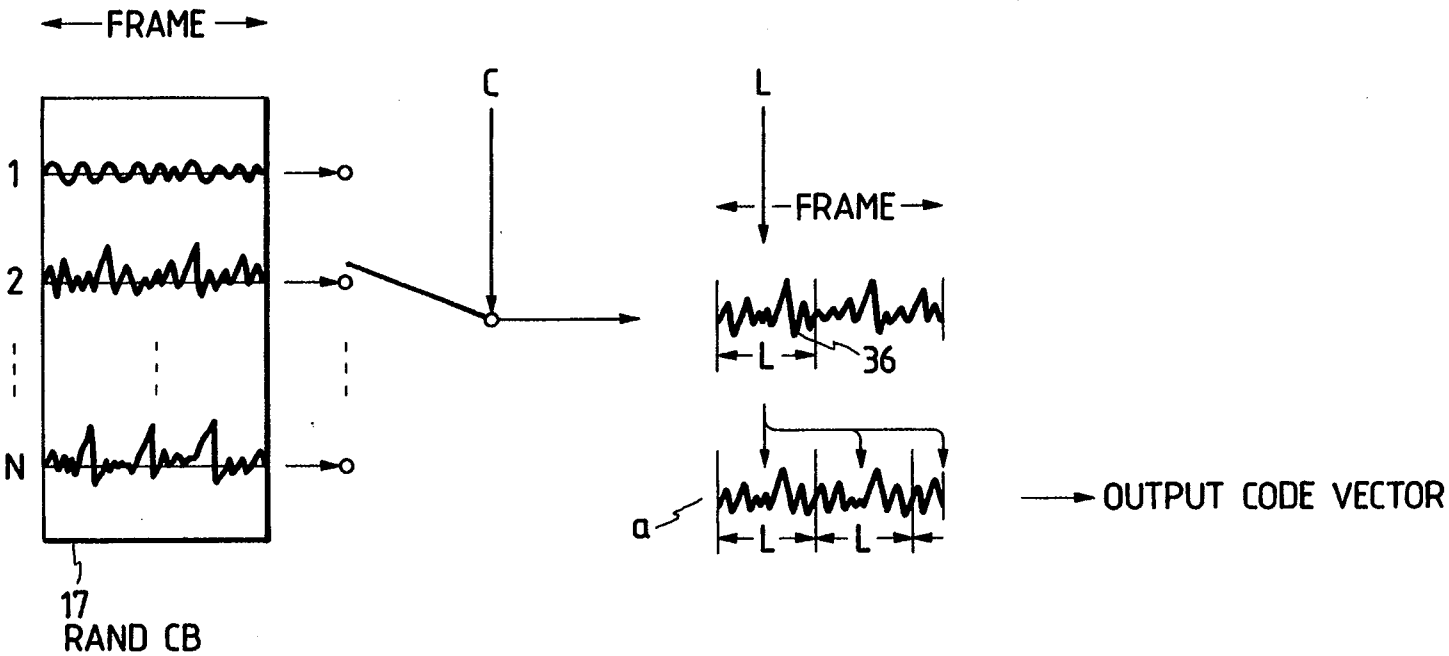
FIG. 6 is a diagram showing a repetitious random vector generation part in a CELP random codebook in the embodiment of FIG. 5.

In step S6, as indicated by a in FIG. 6, a vector segment 36 of the length of the period L determined as mentioned above is cut out from the read out vector and the vector segment 36 thus cut out is repeatedly concatenated until one frame length is reached, by which is generated a codevector provided with periodicity (hereinafter referred to as a repetitious random codevector or repetitious codevector). The vector segment 36 is cut out from the codevector by the length L backwardly of its beginning or forwardly of its terminating end. The vector segment 36 shown in FIG. 6 is cut out from the codevector backwardly of its beginning.

Then, the process proceeds to step S7, wherein the repetitious random codevector is provided to the synthesis filter 15 and a distortion of the reconstructed speech vector X' relative to the input speech vector X is calculated in the distance calculation part 18, taking into account the optimum codevector of the adaptive codebook determined in step S4.

The process goes back to step S5, wherein another codevector of the random codebook is read out and the distortion is similarly calculated in steps S6 and S7. This processing is repeated for all codevectors stored in the random codebook 17.

Then, the process proceeds to step S8, wherein the codevector (and the random code C) of the random codebook which provided the minimum distortion was determined.

Next, the process proceeds to step S9, wherein one of prestored sets of weights ($g_0$, $g_1$) is selected and provided to the multiplication parts $21_0$ and $21_1$.

Next, the process proceeds to step S10, wherein the above-mentioned determined adaptive codevector and the repetitious random codevector are provided to the multiplication parts $21_0$ and $21_1$, and their output vectors are added together in the addition part 22, the added output being provided as an excitation vector candidate to the LPC synthesis filter 15. The reconstructed speech vector X' from the synthesis filter 15 is provided to the distance calculation part 18, wherein the distance (or distortion) between the vector X' and the input vector X is calculated.

Then, the process goes back to step S9, wherein another set of weights is selected, and the distortion is similarly calculated in step S10. This processing is repeated for all sets of weights.

In step S11 the set of weights ($g_0$, $g_1$) which provided the smallest one of the distortions thus obtained and the weight code G corresponding to such a set of weight are determined.

In the manner described above, the period code L, the random code C and the weight code G which minimize the distance between the reconstructed speech vector X' available from the LPC synthesis filter 15 and the input speech vector X are determined as optimum codes by vector quantization for the input speech vector X. These optimum codes are transmitted together with the LPC parameter code A or stored on a recording medium.

In the case of determining a random codevector, taking into consideration the optimum codevector of the adaptive codebook in step S7, two methods can be used for evaluating the distortion of the reconstructed speech vector X' with respect to the input speech vector X. According to a first method, the codevector of the random codebook is orthogonalized by the adaptive codevector and is provided to the LPC synthesis filter 15 to excite it and then the distance between the reconstructed speech vector provided therefrom and the input speech vector is calculated as the distortion. A second method is to calculate the distance between a speech vector reconstructed by the random codevector and the input speech vector orthogonalized by the adaptive codevector. Either method is well-known in this field of art and is a process for removing the component of the adaptive codevector in the input speech vector and the random codevector, but from the theoretical point of view, the first method permits more accurate or strict evaluation of the distortion rather than the second method.

In the case of using a plurality of random codebooks, steps S5 to S7 in FIG. 5 are performed for each of the random codebooks $\mathbf{17}_1$, $\mathbf{17}_2$, . . . and optimum codevectors are selected one by one from the respective codebooks. In such a case, it is also possible to use an arrangement in which repetitious random codevectors obtained by the method shown in FIG. 6 are output from some of the random codebook $\mathbf{17}_1$, $\mathbf{17}_2$, . . . and non-repetitious random codevectors are output from the other random codebooks.

Figure 7:
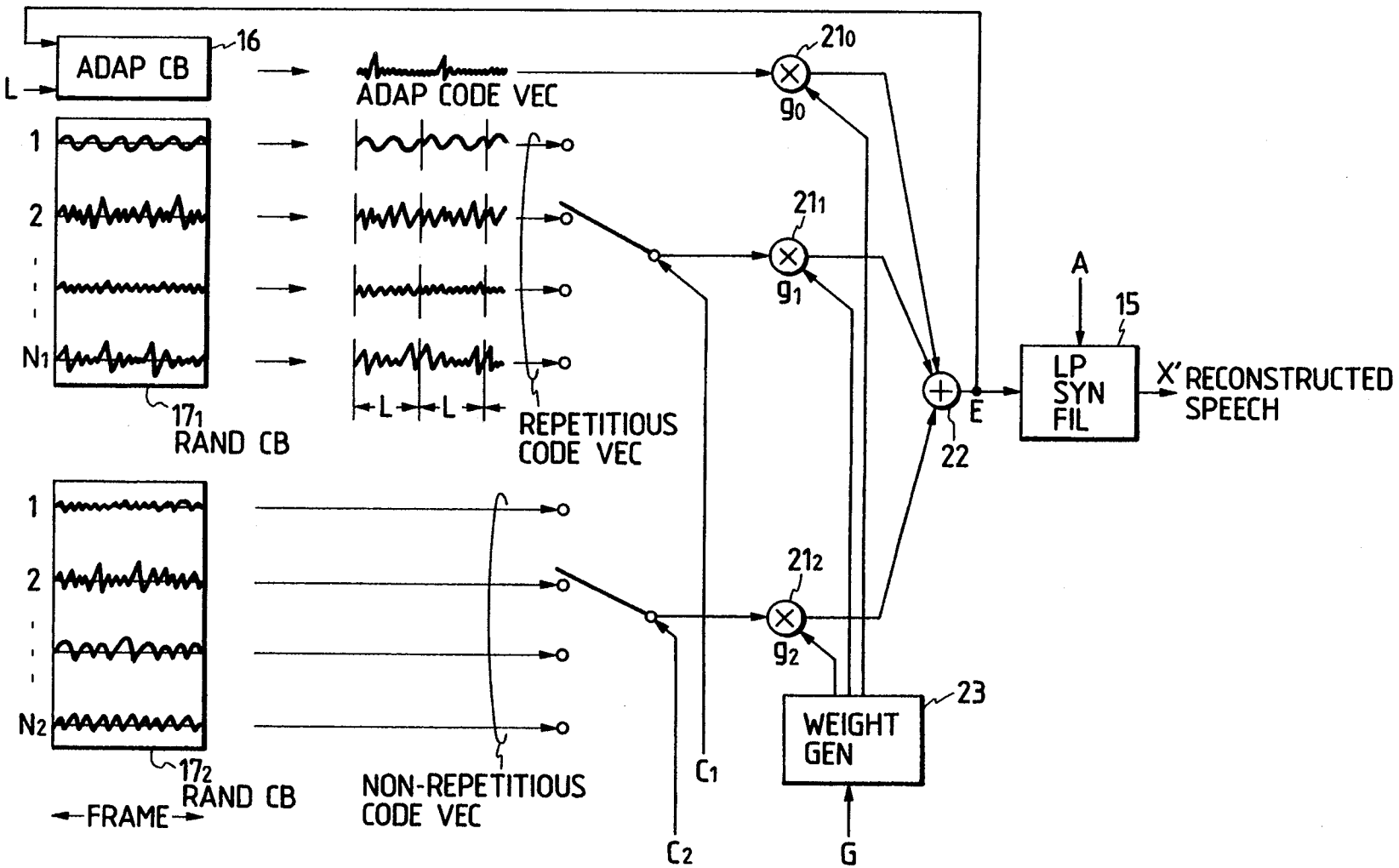
FIG. 7 is a diagram illustrating codebooks and a codebook search part in a modified form of the first embodiment.

FIG. 7 illustrates only the principal part of an example of the construction of the latter. In this instance, the random codebook $\mathbf{17}_1$ outputs repetitious codevectors, whereas the random codebook $\mathbf{17}_2$ outputs its stored vectors intact as codevectors. By a suitable selection of the number of random codebooks which provide repetitious random codevectors and the number of random codebooks which provide non-repetitious random codevectors, the ratio between the ranges of selection of periodic and aperiodic components in the excitation signal E can be set arbitrarily and the ratio can be made to approach the optimum value.

Figure 8:
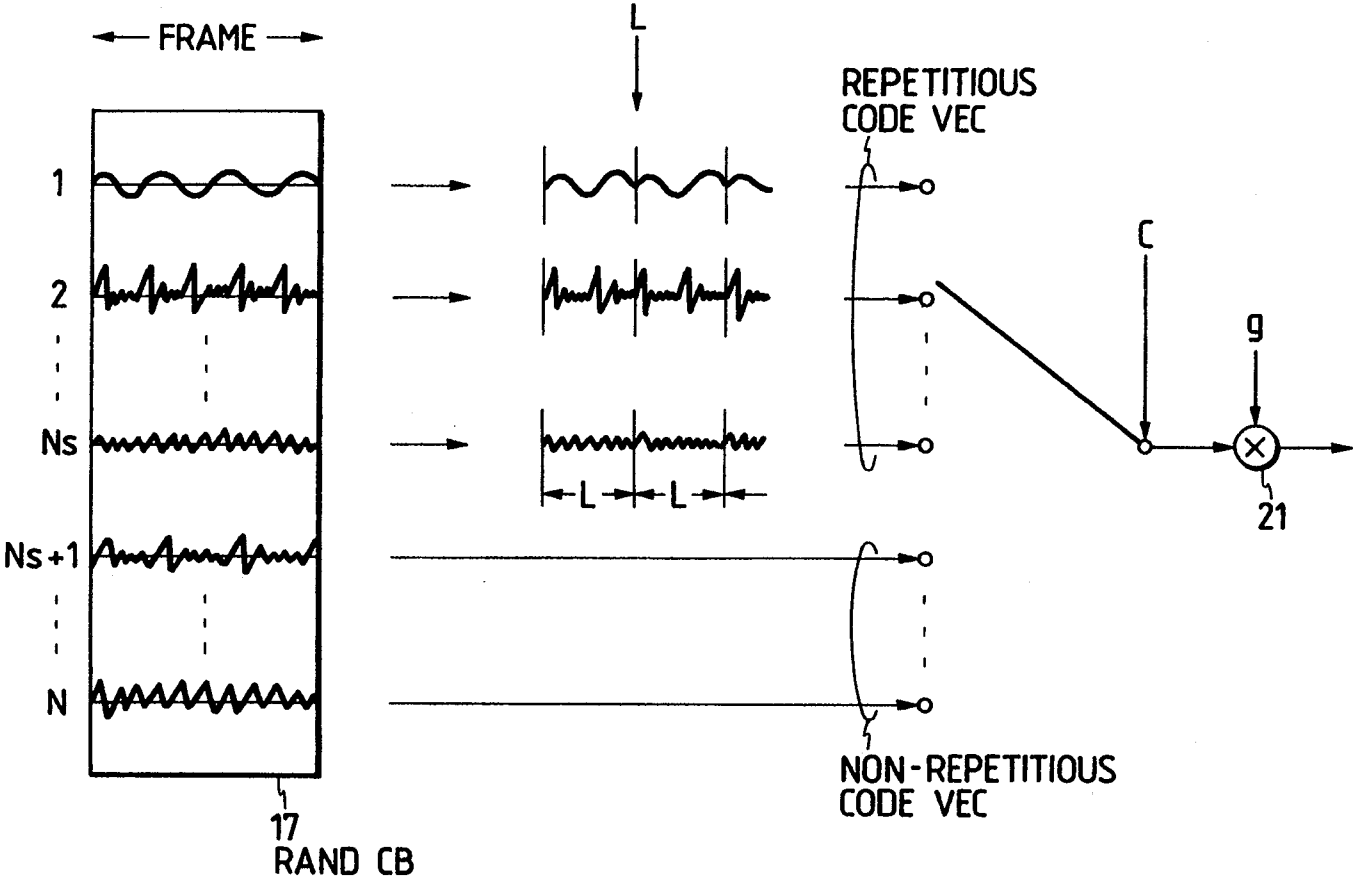
FIG. 8 is a diagram for explaining a repetitious random vector generating process in the modified form of the first embodiment.

It is also possible, in the CELP coding method, that some of the stored vectors in one random codebook are made repetitious and the other remaining vectors are held non-repetitious and used as codevectors. For example, as shown in FIG. 8, stored vectors 1 to $N_S$ in the random codebook 17 are made repetitious and output as codevectors and the other stored vectors $N_{S+1}$ to N are output as non-repetitious codevectors. With such an arrangement, it can automatically be determined, by exactly the same codebook search method as that used in the case of FIG. 5, which of the repetitious codevector and the non-repetitious codevector is suitable for use as the excitation signal E for a certain frame, and this can be done simultaneously with the vector search. That is, the ratio between the ranges of selection of the periodic and aperiodic components can be changed for each frame and made close to an optimum value.

The methods for making the random codevectors repetitious as shown in FIGS. 6 and 7 can similarly be applied to the random codebook in the VSELP coding.

Embodiment 2

Figure 9:
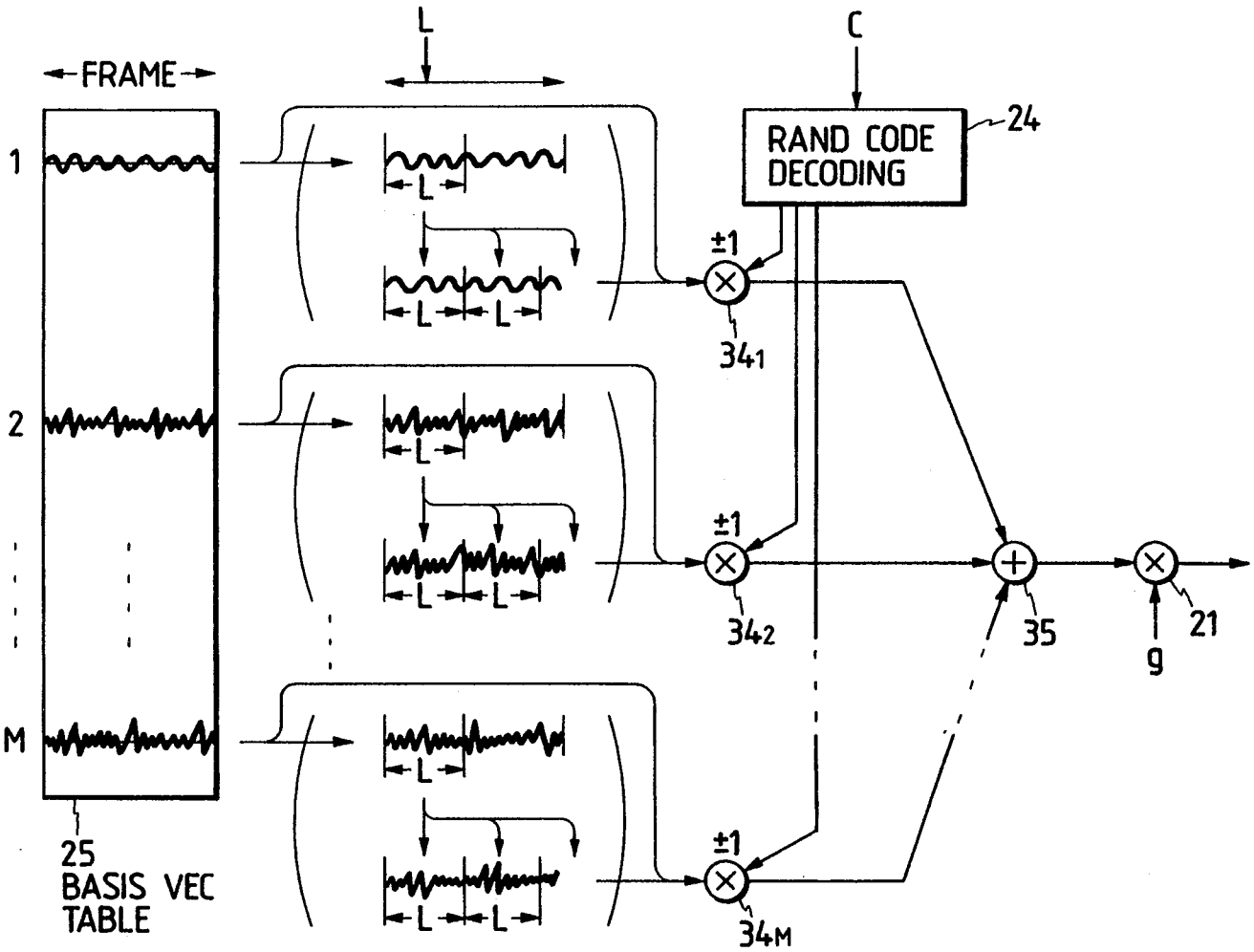
FIG. 9 is a diagram showing a repetitious random vector generation part in a VSELP random codebook in a second embodiment of the present invention.

Next, a description will be given of the application of the invention to the VSELP coding and the CELP coding having a plurality of excitation channels. In the case of VSELP, as depicted in FIG. 9, predetermined ones of M basis vectors are output as repetitious vectors obtained by the aforementioned method and the other vectors are output as non-repetitious vectors. While in FIG. 9 multiplication parts $\mathbf{34}_1$ to $\mathbf{34}_M$ are each shown to be capable of inputting thereinto both of the repetitious basis vector and the non-repetitious basis vector, either one of them is selected prior to the starting of the encoder. The repetitious basis vectors and the non-repetitious basis vectors are each multiplied by a sign value +1 or −1, and the multiplied outputs are added together in an addition part 35 to provide an output codevector therefrom. The selection of the sign value +1 or −1, which is applied to each of the multiplication parts $\mathbf{34}_1$ to $\mathbf{34}_M$, is done in the same manner as in the prior art to optimize the output vector. By making some of the basis vectors in the basis vector table 25 repetitious and holding the remaining basis vectors non-repetitious as mentioned above, the ratio between the numbers of repetitious basis vectors and the non-repetitious basis vectors, i.e. the ratio between the ranges of selection of the periodic and aperiodic components in the excitation signal can be set arbitrarily and can be made close to an optimum value. This ratio is preset.

Figure 10:
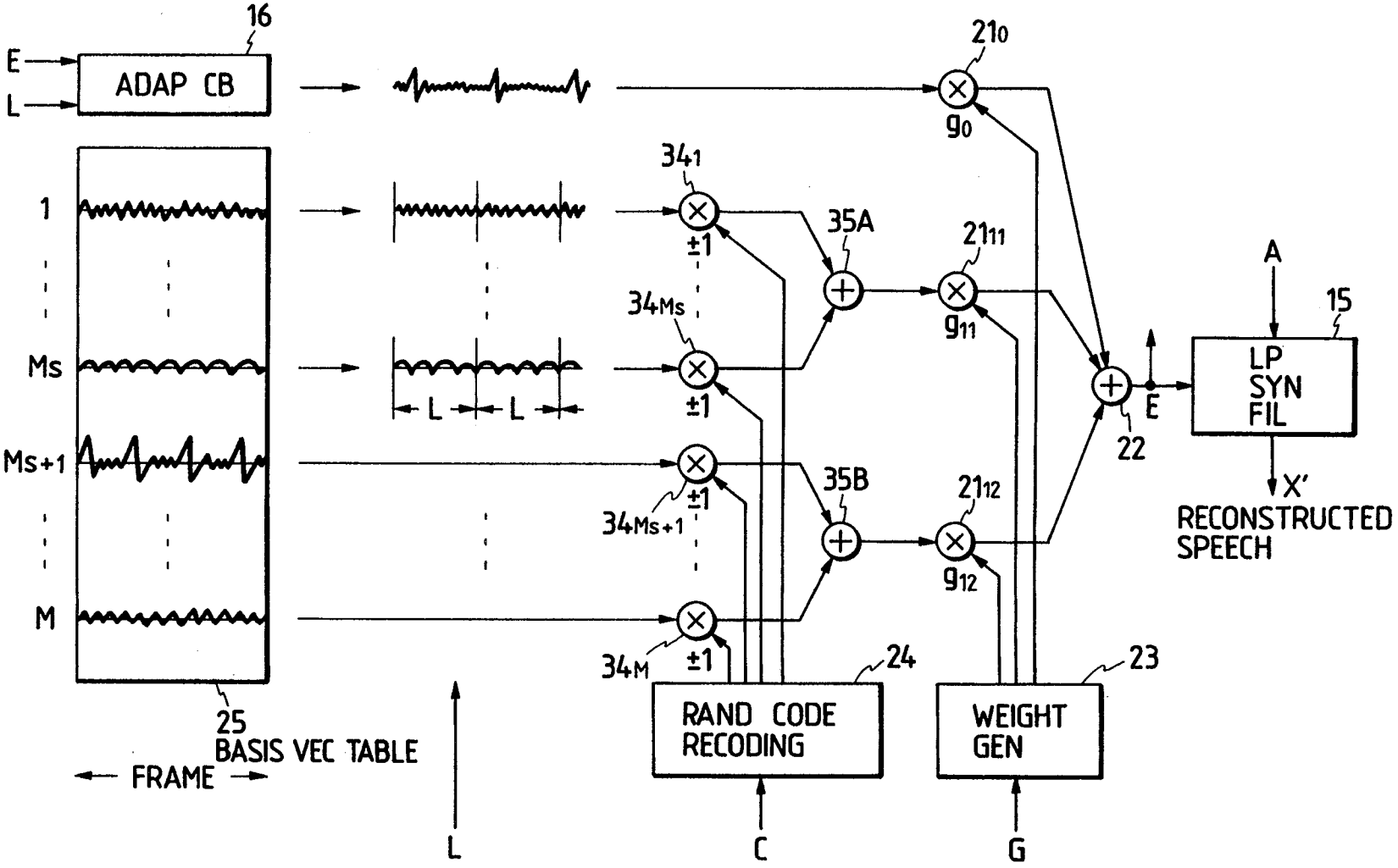
FIG. 10 is a diagram illustrating a modified form of the second embodiment and showing a random codebook, a random codebook search part and an excitation weight search part in the case of weighting a periodic component and an aperiodic component of the VSELP random codebook separately of each other.

According to this method, the search for the optimum codevector can be followed by separate generation of the periodic component (obtained by an accumulation of only the repetitious basis vector multiplied by a sign value) and the aperiodic component (obtained by an accumulation of only the non-repetitious basis vector multiplied by a sign value) of the vector. For instance, as depicted in FIG. 10, in the weight coding of each excitation signal component after the search for the optimum vector the periodic component and the aperiodic component contained in one vector which is output from the accumulation part 22 can be weighted with different values. That is, the basis vectors 1 to $M_S$ are provided with periodicity and the outputs obtained by multiplying them by the signal value +1 or −1 are accumulated in an accumulation part 35A to obtain the repetitious codevector of the random codebook. The remaining basic vectors $M_{S+1}$ to M are held non-repetitious and the outputs obtained by multiplying them by the signal value ±1 are accumulated in an accumulation part 35B to obtain the non-repetitious codevector of the random codebook. The outputs of the accumulation parts 35A and 35B are provided to multiplication parts $\mathbf{21}_{11}$ and $\mathbf{21}_{12}$, wherein they are multiplied by weights $g_{11}$ and $g_{12}$, respectively, and the multiplied outputs are applied to the accumulation part 22. In this instance, the optimum output vector of the random codebook is determined by selecting the signal value +1 or −1 which is provided to the multiplication part $34_1$ to $34_M$, followed by the search for the optimum weights $g_{11}$ and $g_{12}$ for the repetitious codevector and the non-repetitious codevector which are output from the accumulation parts 35A and 35B. The ratio between the periodic component and the aperiodic component of the excitation signal E can be optimized for each frame by changing the ratio as mentioned above.

Figure 11:
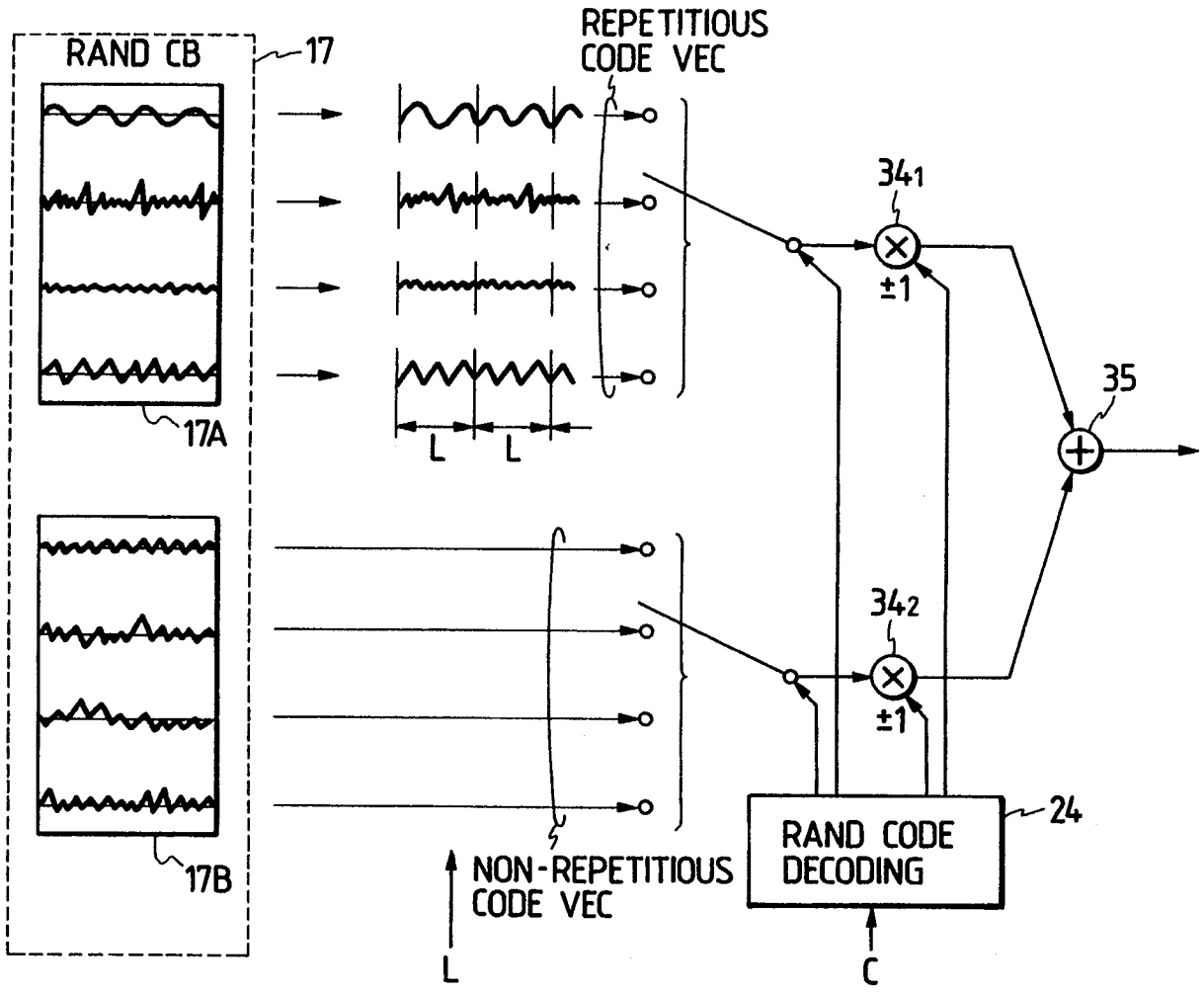
FIG. 11 is a diagram for explaining the repetitious random vector generating process in the modified form of the second embodiment.

In the case of utilizing such a system as shown in FIG. 11 in which the random codebook 17 is formed by, for example, two sub-random codebooks 17A and 17B each composed of four stored vectors, one of the four stored vectors is selected as the output vector of each sub-random codebook, the output vectors are multiplied by the signal value +1 or −1 in the multiplication parts $34_1$ and $34_2$ and the multiplied outputs are accumulated in an accumulation part 35 to obtain the output codevector, it is possible to subject one of the sub-random codebooks to processing for rendering its stored vectors repetitious and to hold the other sub-random codebook non-repetitious. In this example, the output of the sub-random codebook 17A is made repetitious and the output of the sub-random codebook 17B is held non-repetitious.

Figure 12:
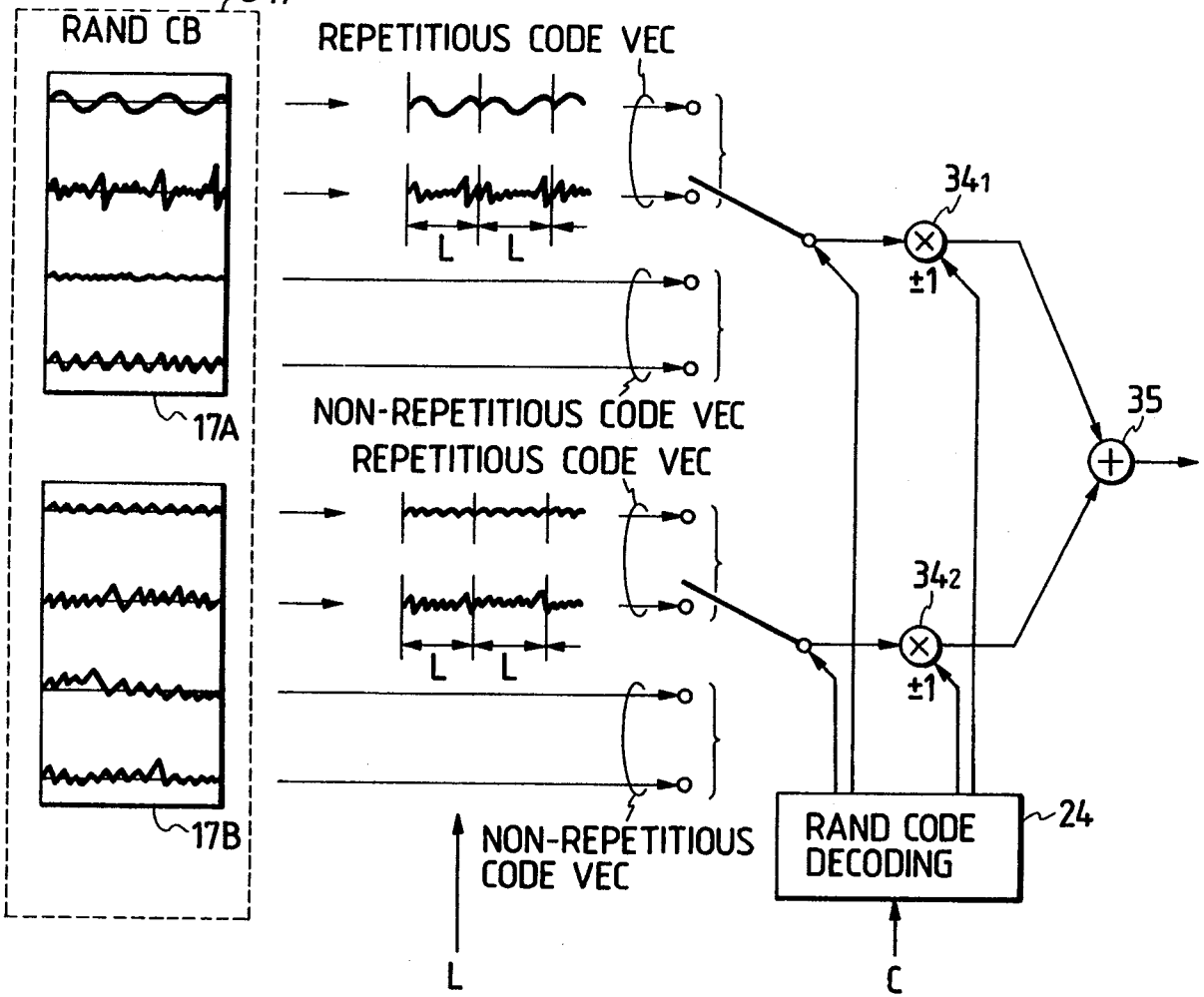
FIG. 12 is a diagram for explaining the repetitious random vector generating process in another modification of the second embodiment.

Nevertheless, some of sub-codevectors in the sub-random codebooks 17A and 17B may also be made repetitious as shown in FIG. 12. In FIG. 12, two of the four vectors in each sub-random codebook are made repetitious.

While in the above the present invention has been described with respect to coding, the random codevector in decoding is also made repetitious under the same conditions as in coding.

As described above, according to this embodiment, the random codevector contained in the excitation signal is made repetitious, and hence the reconstructed speech becomes smooth. In this case, the ratio between the range of selection of the periodic and aperiodic components in the excitation signal can be set to an arbitrary value, which can be made close to the optimum value. Further, the ratio can be changed for each frame by making some of codevectors of one random codebook repetitious. Besides, the periodic and aperiodic components can each be weighted with a different value for each frame and an optimum weight ratio for the frame can be obtained by searching the weight codebook.

Figure 13A:
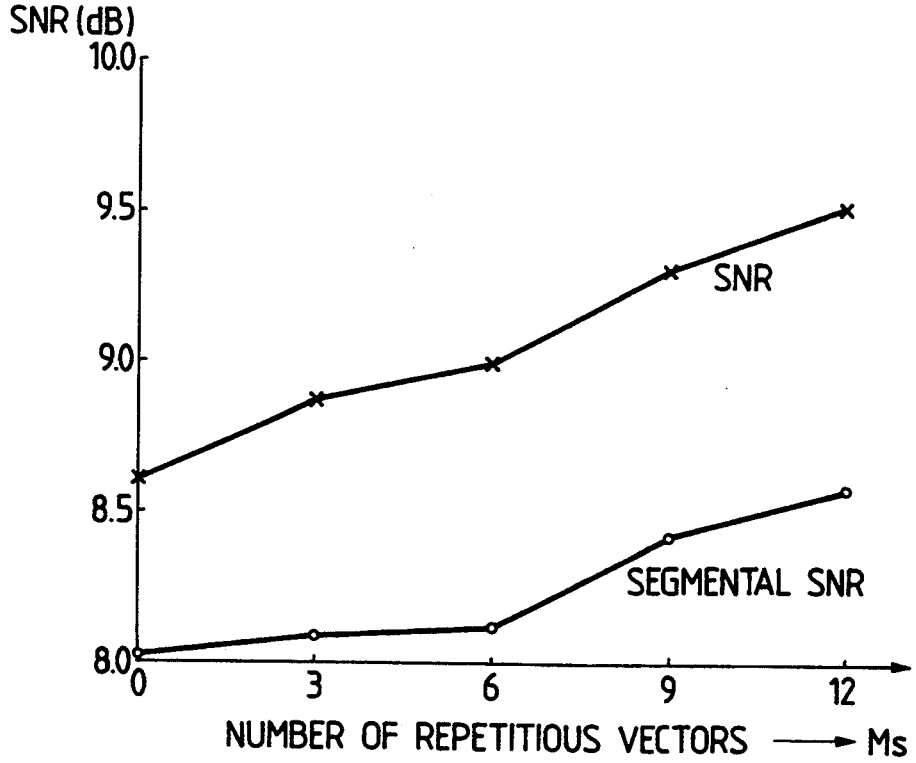
FIG. 13A is a graph showing an SN ratio and a segmental SN ratio, illustrating the effect of the present invention.
Figure 13B:
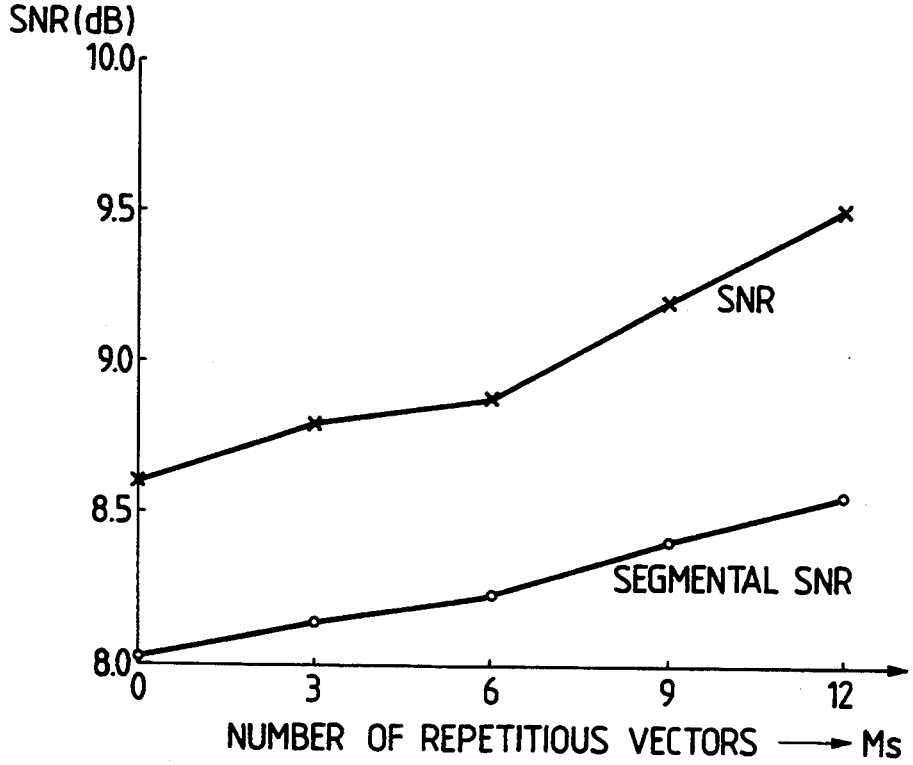
FIG. 13B is a graph similarly showing an SN ratio and a segmental SN ratio, illustrating the effect of the present invention.
Figure 13C:
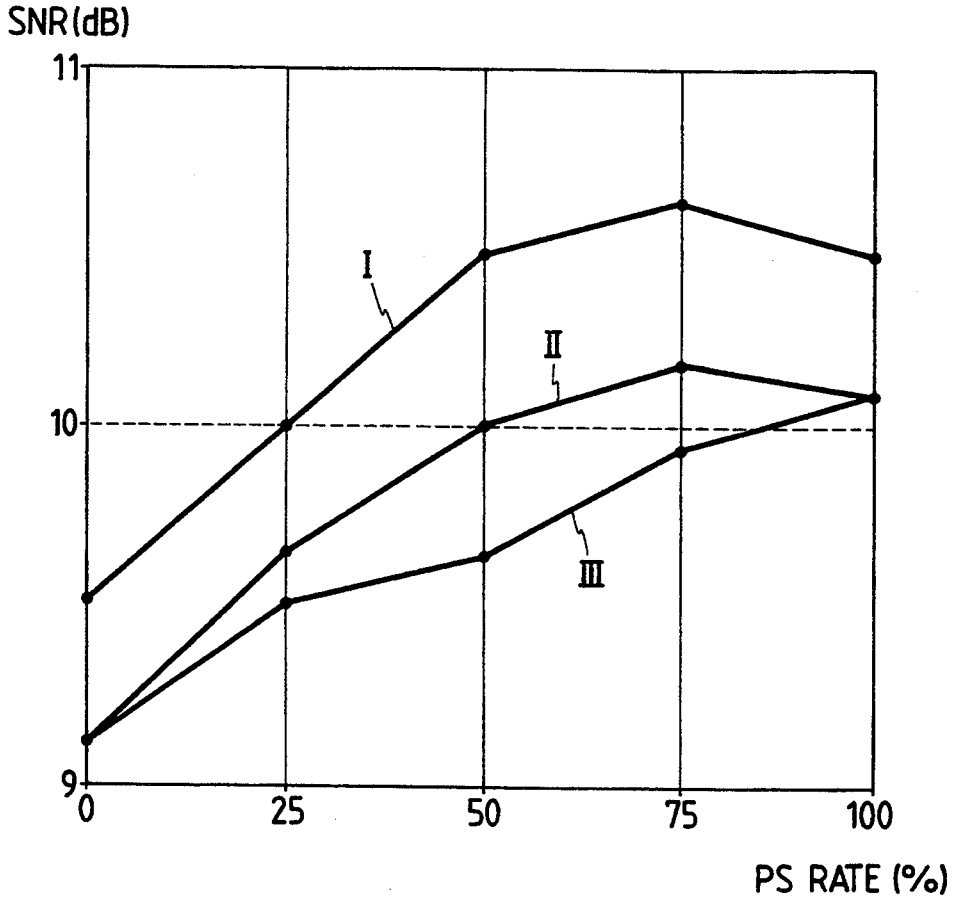
FIG. 13C is a graph showing an SN ratio, illustrating the effect of the present invention.

FIGS. 13A, 13B and 13C show, by way of example, the improving effect on the reconstructed speech quality by speech coding with a coding rate of about 4 kbit/s. FIG. 13A shows the signal-to-noise (SN) ratio and the segmental SN ratio in the case of employing two random codebooks, one being a VSELP type random codebook having $M_S$ basis vectors rendered repetitious and the other being a VSELP type random codebook having (12-$M_S$) non-repetitious basis vectors. FIG. 13B shows the SN ratio and the segmental SN ratio in the case where the number M of basis vectors is 12 in FIG. 9, $M_S$ basis vectors are made repetitious but the remaining vectors are held non-repetitious. From FIGS. 13A and 13B it is seen that the present invention reduces quantizing noise about 1 dB by coding at the rate of 4 kbit/s or so as compared with the conventional system ($M_S$=0) which does not involve the processing for making the codevectors repetitious; thus, the invention improves the synthesized speech quality. Judging from hearing, the tone quality is particularly improved when the number ($M_S$) of repetitious basic vectors in 9 or 10. The curve I in FIG. 13C shows the SN ratio with respect to "the number of repetitious vectors/the total number of vectors" (hereinafter referred to simply as a PS rate) represented on the abscissa in the case where the number N of vectors in each of the two channels of sub-random codebooks 17A and 17B in FIG. 12 is 32. The curve II shows the SN ratio with respect to the PS rate in the case where four sub-random codebooks are used in FIG. 12 and the number N of vectors in each sub-random codebook is 4. The curve III in FIG. 13C shows the SN ratio with respect to "the number of sub-codebooks to be made repetitious/the total number of sub-codebooks" in the case where four sub-random codebooks are used in FIG. 11 and each sub-random codebook has four vectors. In the cases of the curves I and II, the optimum SN ratio can be obtained when the PS rate is 75%.

Embodiment 3

In each of the above-described embodiments the optimum period (i.e. pitch period) L is determined by use of the adaptive codebook alone as shown in FIG. 5 and then the random code C of the random codebook and consequently its random codevector is determined, but it has been found that this method cannot always determine a correct pitch period, for example, a twice the correct pitch period is often determined as optimum. A description will be given of an embodiment of the present invention intended to overcome such a shortcoming.

Figure 14:
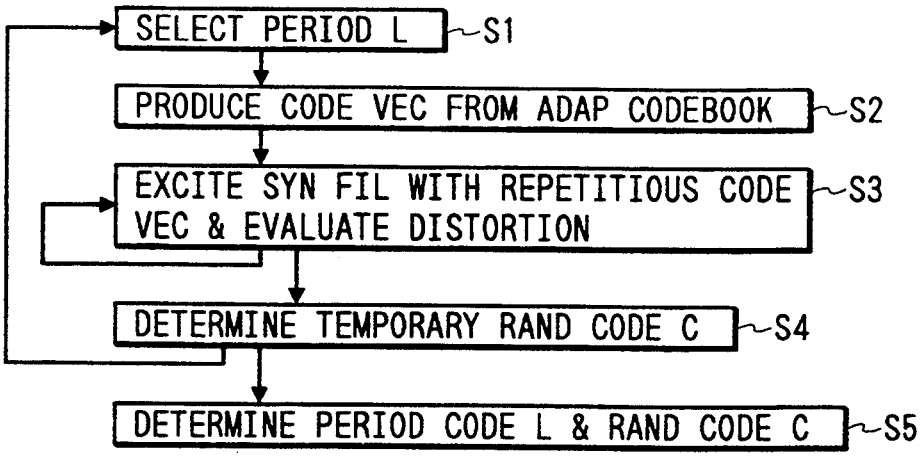
FIG. 14 is a flowchart showing a period determining process which is a principal part of a third embodiment of the present invention.

As depicted in a flowchart in FIG. 14, according to this embodiment, a loop for searching for the optimum codevector of the random codebook is included in a loop for determining the period L by repeating the processing of setting the period L and then evaluating the distortion.

In step S1 one period L is set which is selected within the range of the predetermined pitch period, and in step S2 the codevector of the adaptive codebook is generated as in steps S1 and S2 shown in FIG. 5.

Based on the period L and the adaptive codevector, in step S3 a random codevector read out from the random codebook is made repetitious as shown in steps S5, S6, and S7 in FIG. 5 and FIG. 6, the weighted repetitious random codevector is added to the weighted adaptive codevector, and the added output is applied to the LPC synthesis filter to excite it, then the distortion is calculated. This processing is performed for all the random codevectors of the random codebook.

In step S4 the random code C of the random codevector of the random codebook, which minimizes the distortion, is searched for. This determines the optimum random code C temporarily for the initially set period L.

Thereafter, the process goes back to step S1, wherein a different period is set, and the above-said processing is repeated for all periods L. In step S5 a combination of the period L and the random code C, which minimizes the distortion, is finally obtained from the random codes C temporarily determined for each period L.

Since the random codevector of the random codebook is made repetitious in the loop of searching the period L as described above, the interdependence of the adaptive codevector and the random codevector increases, the possibility of a period twice the period L being determined as optimum will diminish.

Figure 15:
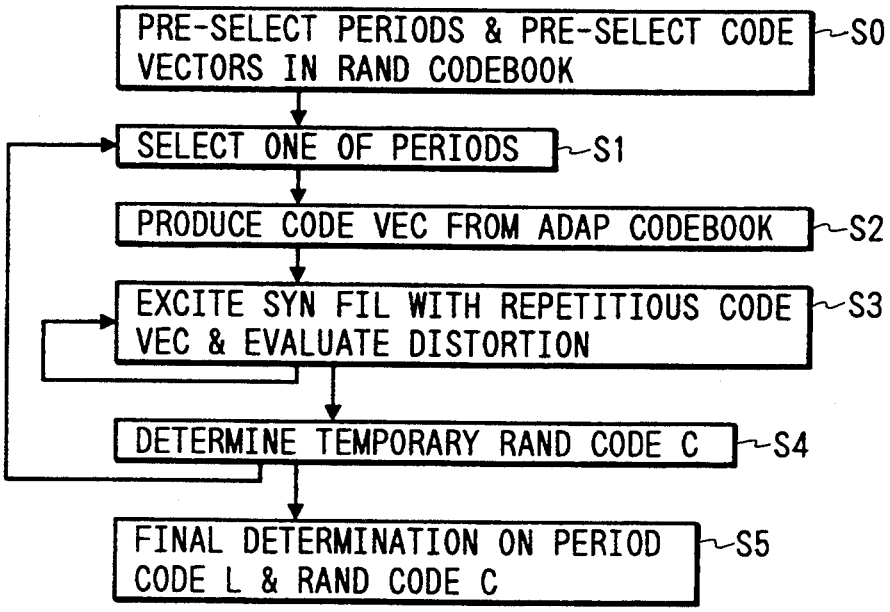
FIG. 15 is a period determining process utilizing a preselection which is the principal part of a modified form of the third embodiment.

FIG. 15 illustrates a modified form of the FIG. 14 embodiment. In this embodiment the random codebook is not searched for all periods L but instead the period L and the random codevector are preselected in step S0 and the random codebook is searched only for each preselected period L in steps S1, S2, S3 and S4. In step S3 the optimum codevector of the random codevector is searched for the preselected codevectors of the random codebook alone. In the previous FIG. 14 embodiment the optimum value is determined in all combinations of the period L and the random code C, the loop for search is double, and consequently, the amount of data to be processed becomes enormous according to conditions. To avoid this, the period L and the codevector of the random codebook are each also searched from a small number of candidates in this embodiment.

For the preselection of the periods L, the distortion is evaluated using only codevectors of the adaptive codebook as in the prior art and a predetermined number of periods are used which provided in the smallest distortions. It is also possible to use, as the candidates for the period L, a plurality of delays which increase an auto-correlation of a LPC residual signal which is merely derived from the input speech in the speech analysis part 12 in FIG. 1. That is, the delays which increase the auto-correlation are usually used as the candidates for the pitch period, but in the present invention the delays are used as the preselected values of the period L. In the case of obtaining the pitch period on the basis of the auto-correlation, no distance calculation is involved, and consequently, the computational complexity is markedly reduced as compared with that involved in the case of obtaining the pitch period by the search of the adaptive codebook.

The random codevectors (and their codes) of the random codebook are preselected by such a method as mentioned below. The codevectors of the random codebook are made repetitious using one of the preselected periods L, distortions are examined which are caused in the cases of using the repetitious random codevectors, and a plurality of random codevectors (and their codes) are selected as candidates in increasing order of distortion. The alternative is a method according to which one period is determined on the basis of the output from the adaptive codebook alone, the correlation is obtained between the input speech vector and each random codevector orthogonalized by the adaptive codevector corresponding to the period, and then random codevectors corresponding to some of high correlations are selected as candidates.

Then, in steps S1 through S4 distortion of the synthesized speech is examined which is caused in the case where each of such preselected codevectors of the random codebook is made repetitious using each of the preselected periods, and that one of combinations of the preselected random codevectors and preselected periods which minimizes the distortion of the synthesized speech is determined in step S5.

In the above, all codevectors of the random codebook need not always be rendered repetitious and only predetermined ones of them may be made repetitious. The random codevectors may be made repetitious using not only the period obtained with the adaptive codebook but also periods twice or one-half of that period. Further, the present invention is applicable to VSELP coding as well as to CELP coding.

As described above, the codevectors of the random codebook are made repetitious in accordance with the pitch period and repetition period, i.e. the pitch period is determined taking into account the codevectors of the adaptive codebook and the random codebook. This increases the interdependence of the codevector from the adaptive codebook and the codevector from the random codebook on each other, providing the optimum repetition period which minimizes the distortion in the frame. Accordingly, coding distortion can be made smaller than in the case where the pitch period of the adaptive codebook is obtained and is used intact as the repetition period of the random codebook. Besides, the combines use of preselection makes it possible to obtain substantially an optimum period with a reasonable amount of data to be processed.

Embodiment 4

In the above-described embodiments the random codevector is made repetitious only using the pitch period of the adaptive codebook, but improvement in this processing will permit a speech coding and decoding method which provides a high quality coded speech even at a low bit rate of 4 kbit/s so. This will be described hereinbelow with reference to FIG. 16.

Figure 16:
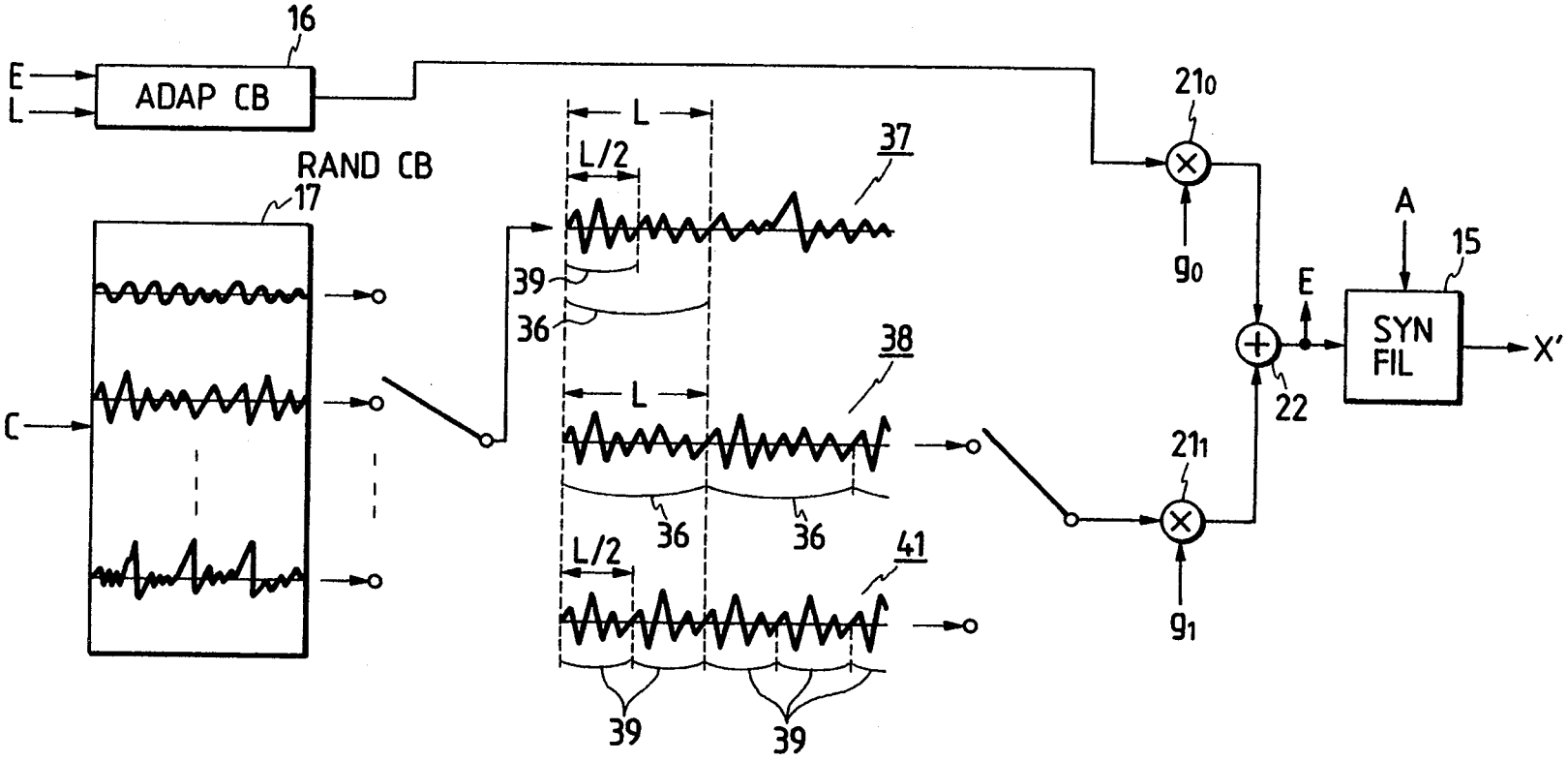
FIG. 16 is a diagram showing a part of a random codebook search which is the principal part of a fourth embodiment of the present invention.

FIG. 16 illustrates only the principal part of the embodiment. The encoder used is identical in block diagram with the encoder depicted in FIG. 1. As is the case with the FIG. 5 embodiment, the adaptive codebook 16 is used to select the period L which minimizes the distortion of the synthesized speech. Next, the random codebook 17 is searched. In this embodiment stored vectors of the random codebook 17 are taken out one by one, a vector segment 36 having the length of the period L obtained with the adaptive codebook 16 is cut out from the stored vector 37, and the vector segment 36 thus cut out is repeated to form a repetitious codevector 38 of one frame length. Moreover, a vector segment 39 having a length one-half the period L is cut out from the same stored vector and the cut-out vector segment 39 is repeated to form a repetitious codevector 41 of one frame length. These repetitious codevectors 38 and 41 are individually provided to the multiplication part $21_1$. In this case, it is necessary to send a code indicating whether the period L of L/2 was used to make the selected random codevector repetitious to the decoding side together with the random code C. This embodiment is identical with the FIG. 5 embodiment except for the above.

As mentioned above, in this embodiment each codevector of the random codebook 17 is made repetitious with the period L and the codevector of the random codebook which minimizes the distortion of the synthesized speech is searched taking into account of the optimum codevector of the adaptive codebook. In addition, each codevector of the random codebook 17 is made repetitious with the period L/2 and the codevector of the random codebook 17 which minimizes the distortion of the synthesized speech is searched taking into account of the optimum codevector of the adaptive codebook. Thus, the codevectors of the random codebook 17 which minimizes the distortion of the synthesized speech can be obtained as a whole.

In the search of the adaptive codebook, a codevector of a length twice the pitch period is often detected as the codevector which minimizes the distortion. In such an instance, according to this embodiment, that one of the codevectors of the random codebook made repetitious with the period L/2 which minimizes the distortion is selected.

Figure 17:
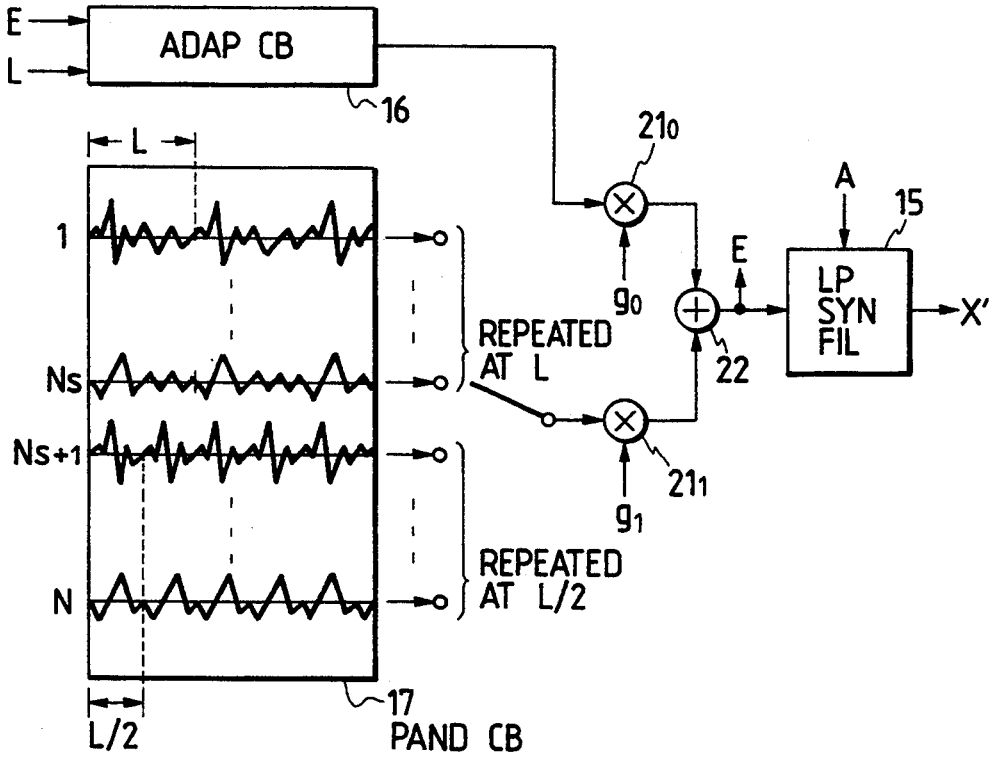
FIG. 17 is a diagram illustrating a modified form of the fourth embodiment.

As shown in FIG. 17, it is also possible to make codevectors 1 to $N_S$ of the random codebook 17 repetitious with the period L and codevectors $N_{S+1}$ to N repetitious with the period L/2. Also in this case, when the period L becomes twice the pitch period, the codevector which minimizes the distortion of the synthesized speech is selected from the codevectors $N_{S+1}$ N. In the example of FIG. 16 it is necessary to send to the decoding side, together with the random code C indicating the selected random codevector, a code indicating whether the period L or L/2 was used to make the selected random codevector repetitious, but the example of FIG. 17 does not call for sending such a code.

The random codevector of the random codebook can be made repetitious using the optimum period L obtained from the adaptive codebook, the aforementioned period L/2, a period 2L, an optimum period L' obtained by searching the adaptive codebook in the preceding frame, a period L'/2, or 2L'.

Figure 18:
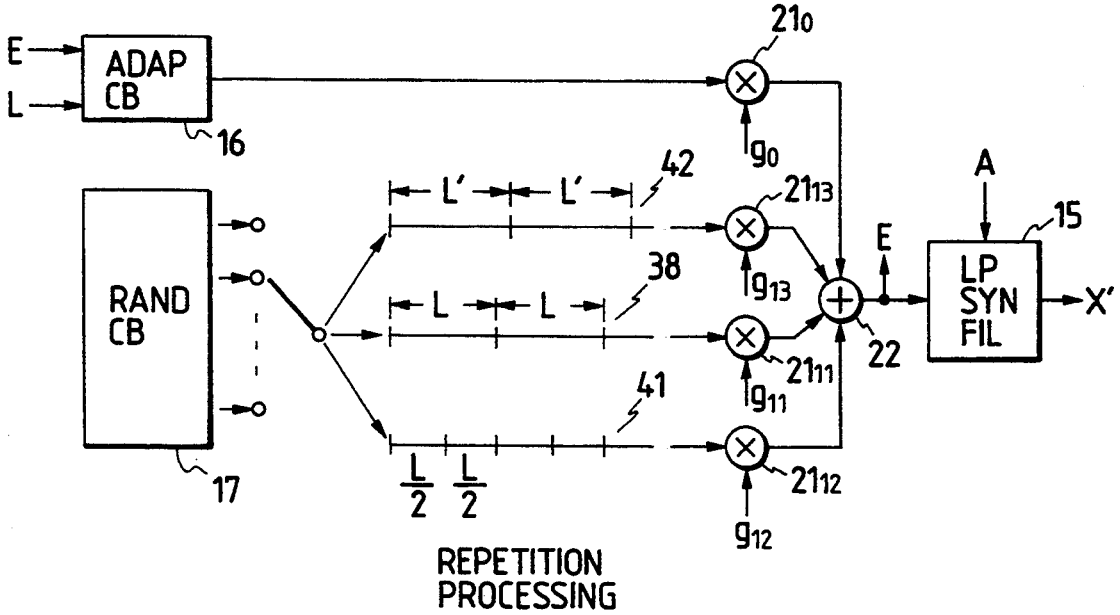
FIG. 18 is a diagram illustrating another modification of the fourth embodiment.

FIG. 18 illustrates another modified form of the FIG. 16 embodiment. In this instance, codevectors of the random codebook 17 are made repetitious with the period L identical with the optimum period obtained by the search of the adaptive codebook 16 and the codevector is selected which minimizes the distortion of the synthesized speech. Then, the selected codevector is made repetitious with other periods L' and L/2 in this example as shown in FIG. 18, thereby obtaining codevectors 41 and 42. In multiplication parts $21_{11}$, $21_{12}$ and $21_{13}$ and the accumulation part 22, the repetitious codevectors 41 and 42 and the codevector 38 made repetitious with the period L are subjected to a weighted accumulation, by which are obtained gains (i.e., weights) $g_{11}$, $g_{12}$ and $g_{13}$ for the repetitious codevectors 38, 41 and 42 which minimize the distortion of the synthesized speech. In this instance, if the pitch period L used in the adaptive codebook 16 is sufficiently ideal, then the gain $g_{11}$ for the random codevector made repetitious with that period will automatically increase. Conversely, if the period L is not desirable, the gain $g_{12}$ or $g_{13}$ for the random codevector rendered repetitious with a more suitable period L/2 or L' will increase.

It is also possible to employ a method in which when the codevectors of the random codebook 17, the codevector are each made repetitious with plural kinds of periods, for example, L, L/2 and L', and these repetitious codevectors are each accumulated with a predetermined weight, the distortion of the accumulated vector with respect to the input speech vector is calculated, similar distortions of the other vectors are obtained, and in connection with the vector which minimizes the distortion of the synthesized speech, gains of the weighted accumulations of the codevectors prior to the synthesization, for example, 38, 31 and 42, which minimize the distortion, are obtained.

Figure 4:
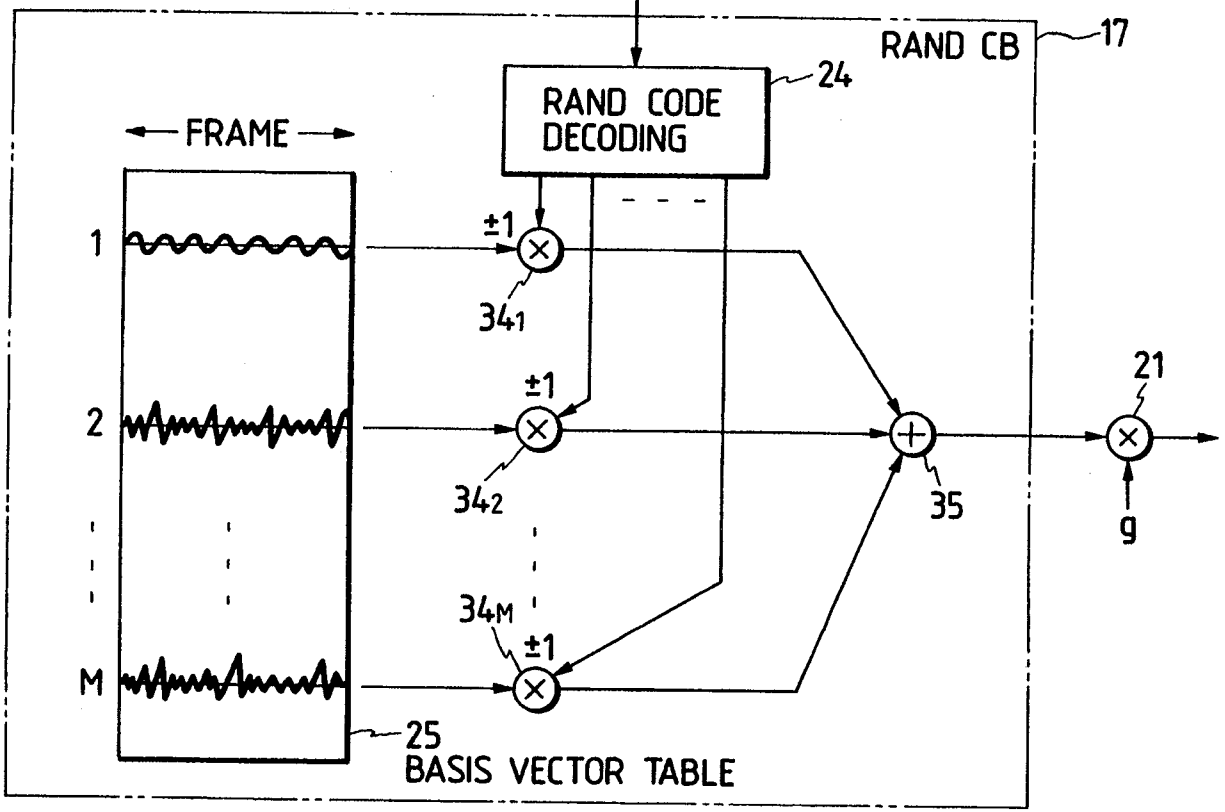
FIG. 4 PRIOR ART
FIG. 4 is a diagram showing a random codebook for use in conventional VSELP coding.

Also it is possible to use a method in which some of the codevectors of the random codebook 17 (or the basis vectors in FIG. 4) are made repetitious with the period L, the same codevectors or other codevectors are rendered repetitious with some other period, and the remaining codevectors are left non-repetitious.

As described above, according to this embodiment, even if the pitch period searched in the adaptive codebook is not correct, codevectors of the random codebook are made repetitious with a desirable period, and consequently, the distortion of the synthesized speech can be further reduced. In particular, the pitch period obtained by searching the adaptive codebook may sometimes be twice the original pitch period, but the distortion in this case can be reduced.

Embodiment 5

Figure 19:
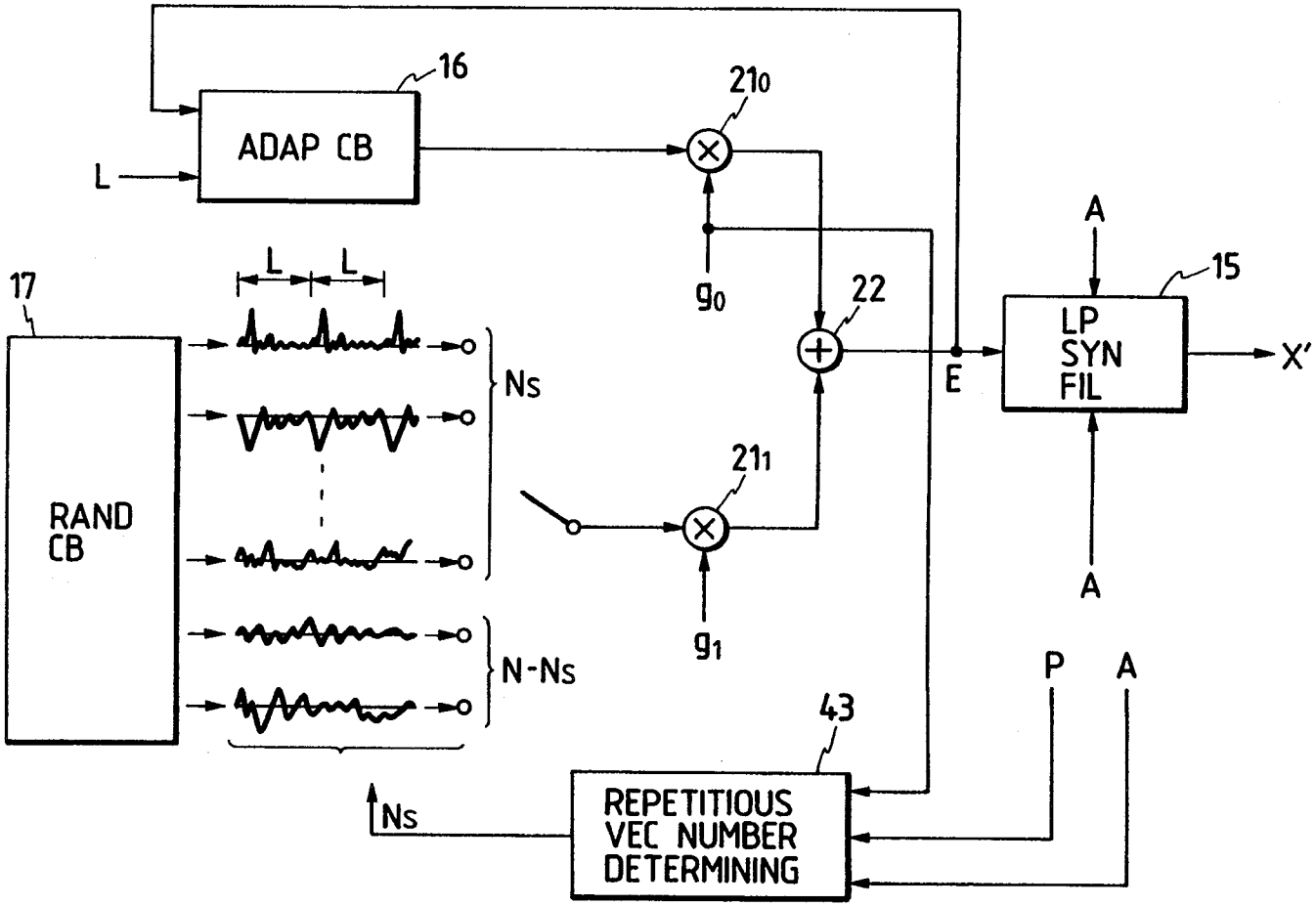
FIG. 19 is a block diagram illustrating the principal part of a fifth embodiment of the present invention.

As described previously, for example, in respect of the FIG. 8 embodiment, even if the periodicity of the input speech is low, an optimum vector can be selected by selectively making the codevectors in the random codebook 17 repetitious. FIG. 19 illustrates an embodiment improved from the FIG. 8 embodiment.

In this embodiment the search of the adaptive codebook 16 for the basic period is the same as in the embodiment of FIG. 5. According to this example, a part 43 for determining the number of codevectors to be made repetitious is provided in the encoder shown in FIG. 1, by which the periodicity of the current frame of the input speech is evaluated. The periodicity of the input speech is evaluated on the basis of, for example, the gain $g_0$ for the adaptive codevector and the power P and the spectral envelope configuration (the LPC parameters) A both derived from the input speech in the speech analysis part 12 in FIG. 1, and the number Ns of random codevectors in the random codebook 17 to be rendered repetitious is determined in accordance with the periodicity of the input speech.

Figure 20A:
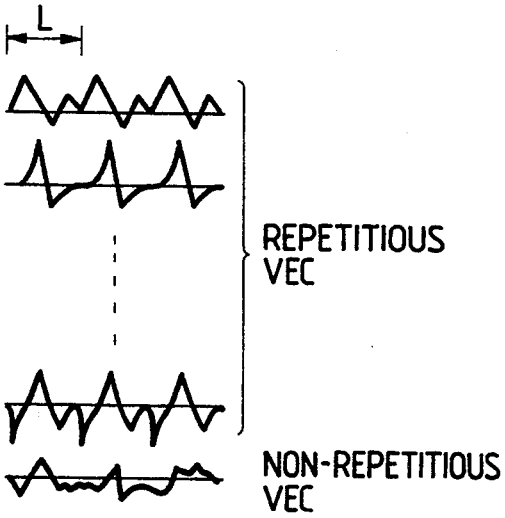
FIG. 20A is a diagram showing the state in which the rate of the number of repetitious vectors to the number of non-repetitious vectors is high.
Figure 20B:
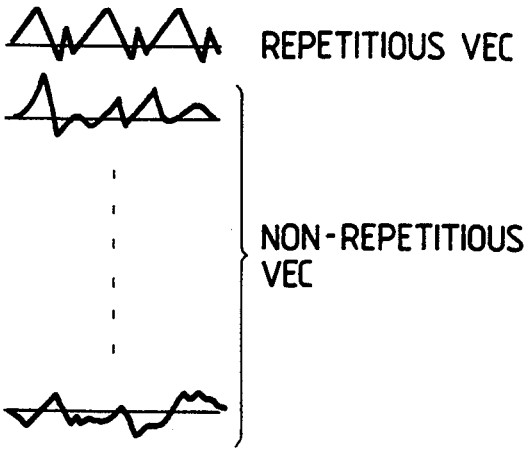
FIG. 20B is a diagram showing the state in which the rate of the number of repetitious vectors to the number of non-repetitious vectors is low.
Figure 21A:
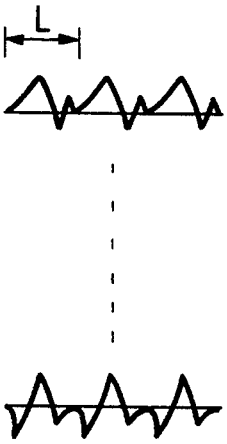
FIG. 21A is a diagram showing repetitious vectors when their periodicity is high.
Figure 21B:
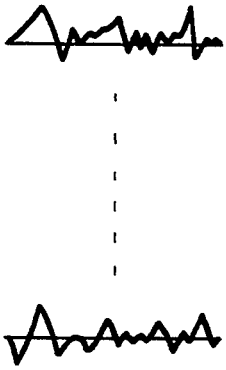
FIG. 21B is a diagram showing repetitious vectors when their periodicity is low.

For instance, when the periodicity of the speech frame is evaluated high, the number Ns of random codevectors to be made repetitious with the pitch period L is selected large as shown in FIG. 20A, whereas when the evaluated periodicity is low, the number Ns of random codevector to be made repetitious is selected small as depicted in FIG. 21B. In the case of quantizing the pitch gain $g_0$ prior to the determination of the optimum codevector of the random codebook 17, the pitch gain $g_0$ is used as the evaluation of the periodicity and the number Ns of random codevectors to be made repetitious is determined substantially in proportion to the pitch gain $g_0$. In the case where after the determination of the random codevector the pitch gain $g_0$ is determined simultaneously with the determination of the gain $g_1$ of the determined random codevector, the slope of the spectral envelope and the power of the speech are used as estimated periodicity. Since the periodicity of the speech frame has high correlation with the power of the speech and the slope of its spectral envelope (a first order coefficient), the periodicity can be evaluated on the basis of them.

Figure 3:
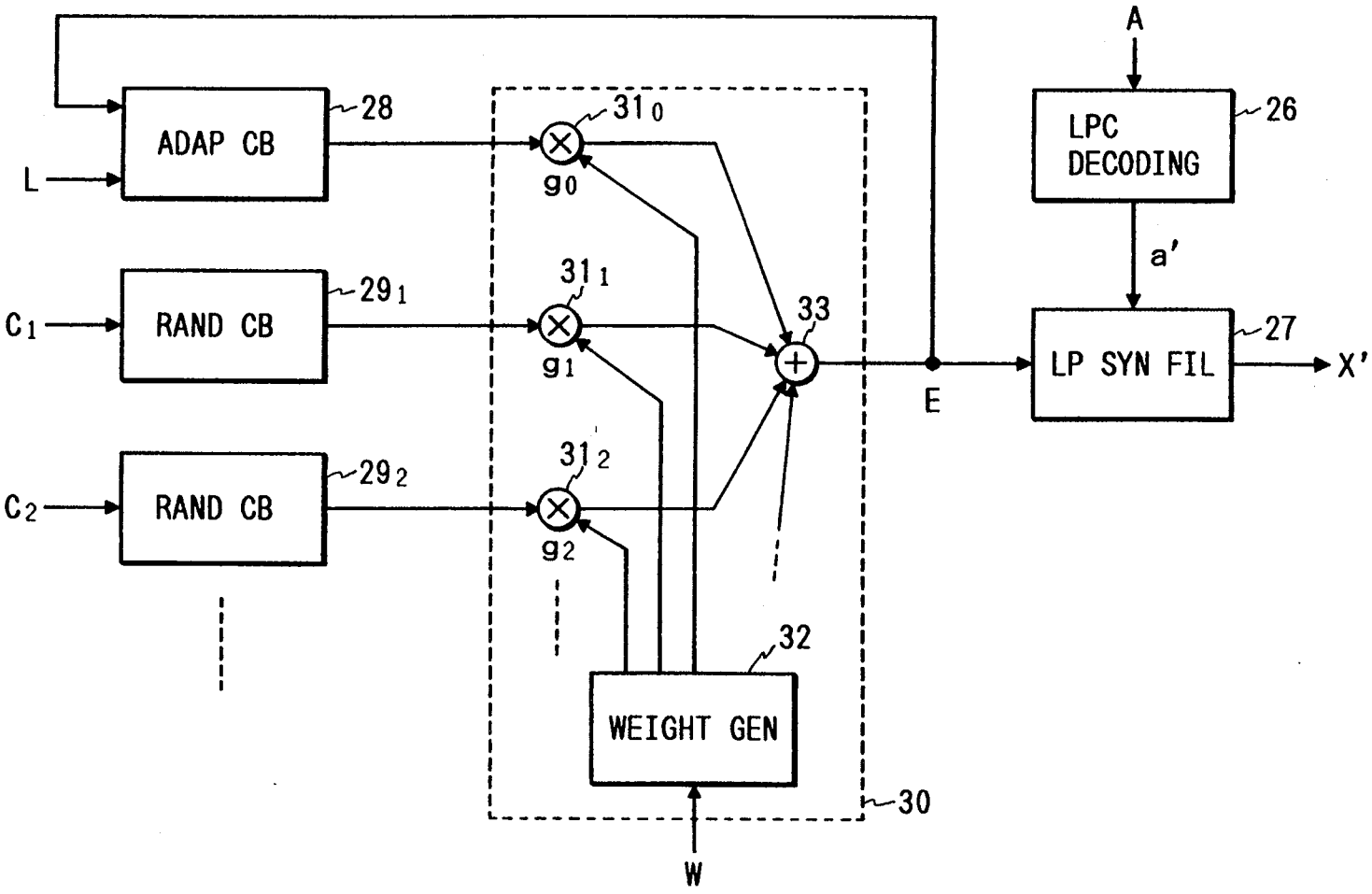
FIG. 3 PRIOR ART
FIG. 3 is a block diagram showing a general construction of a decoder for use with the conventional linear predictive coding.

It is also possible to utilize the periodicity of a speech frame already decoded. That is, the decoded speech is available in the coder and the decoder in common to them as seen from FIGS. 1 and 3, and the periodicity of the speech frame does not abruptly change in adjoining speech frames; hence, the periodicity of the preceding speech frame may also be utilized. The periodicity of the preceding speech frame is evaluated, for example, in terms of auto-correlation. In the above, since the periodicity of the current speech frame is evaluated on the basis of data handled in the conventional coding or the previously encoded speech, there is no particularly need of furnishing the decoding side with information for controlling the periodicity, but an independent parameter indicating the periodicity may be transmitted to the decoding side. At any rate, the decoding side performs exactly the same processing as that in the encoding side. Besides, it is predetermined in accordance with the periodicity of the speech frame which of the codevectors in the random codebook 17 are to be made repetitious.

In the encoder, the determination of the number of random codevectors to be rendered repetitious is followed by the determination of the vector which minimizes the distortion of the synthesized speech, relative to the input speech vector. Also in the decoder, similar periodicity evaluation is performed to control the number of random codevectors to be rendered repetitious and the excitation signal E is produced accordingly, then a LPC synthesis filter (corresponding to the synthesis filter 27 in FIG. 3) is excited by the excitation signal E to obtain the reconstructed speech output.

The control of the degree to which the codevectors of the random codebook are each made repetitious is not limited specifically to the control of the number Ns of codevectors to be made repetitious, but it may also be effected by a method in which repetition degree is introduced in making one codevector repetitious and the degree of repetitiousness is controlled in accordance with the evaluated periodicity. For example, assuming that the repetition degree $\gamma(0 \leqq \gamma \geqq 1)$ is determined in dependence on the evaluated periodicity and letting L represent the pitch period and C(i) an $i^{th}$ element (the sample number) of a certain random codevector C in the random codebook 17, an $i^{th}$ element C′ (i) of a vector to be made repetitious is expressed as follows:

$$C'(i)=C(i) \text{ for } 1 \leqq i \leqq L$$

$$C'(i)=\gamma C'(i-L)+(1-\gamma)C(i) \text{ for } i>L.$$

That is, when $\gamma=1$, the codevector is made completely repetitious and when $\gamma=0$, the codevector is not made repetitious. When $0<\gamma<1$, the vector component $(1-\gamma)$C(i) held non-repetitious remains as a non-repetitious component in the repetitious codevector C′. For example, as seen from FIGS. 21A and 21B which show the cases where the repetition degree $\gamma$ is large and small, respectively, the repetitious codevector varies with the value of the repetition degree $\gamma$. In the case of controlling the number of codevectors to be made repetitious, the number is selected larger with an increase in the evaluated periodicity. In the case of controlling the repetition degree $\gamma$, the degree $\gamma$ is selected larger with an increase in the evaluated periodicity. It is possible, of course, to combine the control of the number of codevectors to be made repetitious and the control of the repetition degree $\gamma$.

In the above, the control of the repetitious codevectors is not only the control of the number of codevectors to be made repetitious but also the number of basis vectors to be made repetitious in the case of VSELP coding, and the control of the repetition degree $\gamma$ may also be effected by controlling the repetition degree in making the basis vectors repetitious. While in the above the codevectors are made repetitious using the period L obtained by searching the adaptive codebook in the frame concerned, the period L may also be those L′, L/2, 2L, L′/2, etc. which are obtained by searching the adaptive codebook of the preceding frame.

As described above, in this embodiment, in the frame of a speech of a high pitch periodicity, that is, in the frame of a voiced sound, codevectors of the random codebook are made repetitious in a manner to emphasize the periodic component of the pitch to the maximum, and in the frame of a speech of a low pitch periodicity, that is, in the frame of an unvoiced sound, no codevector of the random codebook is rendered repetitious. This reduces the distortion of the encoded speech and improves its quality. In the case of performing this adaptive processing entirely on the basis of information already transmitted and the preceding decoded speech, no particular increase is caused in the amount of information to be transmitted.

Embodiment 6

In the determination of the pitch period in the adaptive codebook 16 it is effective to employ a method of determining the pitch period by using a waveform distortion of the reconstructed speech as a measure to reduce the distortion, or a method employing the period of a non-integral value. More specifically, it is preferable to utilize, as a procedure using the pitch period, a method in which for each pitch period L the excitation signal (vector) E in the past is cut out as a waveform vector segment, going back to a sample point by the pitch period from the current analysis starting time point, the waveform vector segment is repeated, as required, to generate a codevector and the codevector is used as the codevector of the adaptive codebook.

The codevector of the adaptive codebook is used to excite the synthesis filter. In this instance, the vector cut-out length in the adaptive codebook, i.e. the pitch period, is determined so that the distortion of the reconstructed speech waveform obtained from the synthesis filter, relative to the input speech, is minimized.

The desirable pitch period to be ultimately obtained is one that minimizes the ultimate waveform distortion, taking into account its combination with the codevectors of the random codebook, but it involves enormous computational complexity to search combinations of codevectors of the adaptive codebook 16 and the codevectors of the random codebooks $\mathbf{17}_1$ and $\mathbf{17}_2$, and hence is impractical. Then, in this embodiment, the pitch period is determined which minimizes the distortion of the reconstructed speech when the synthesis filter 15 is excited by only the codevector of the adaptive codebook 16 with no regard to the codevectors of the random codebooks. In many cases, however, the pitch period thus determined differs from the ultimately desirable period. This is particularly conspicuous in the case of employing the coding method of FIG. 5 in which the codevectors of the random codebooks are also made repetitious using the pitch period.

Either of the above-mentioned methods involves computational complexity 10 times or more than that in a method which obtains the pitch period on the basis of peaks of the auto-correlation of a speech waveform, and this constitutes an obstacle to the implementation of a real-time processor. Even with a method which selects a plurality of candidates for the pitch period in step S0 in FIG. 15 and searching only the candidates for the optimum pitch period in step S1 et seq. using the measure of minimization of the waveform distortion so as to decrease the computational complexity, the waveform distortion cannot always be reduced.

Figure 22:
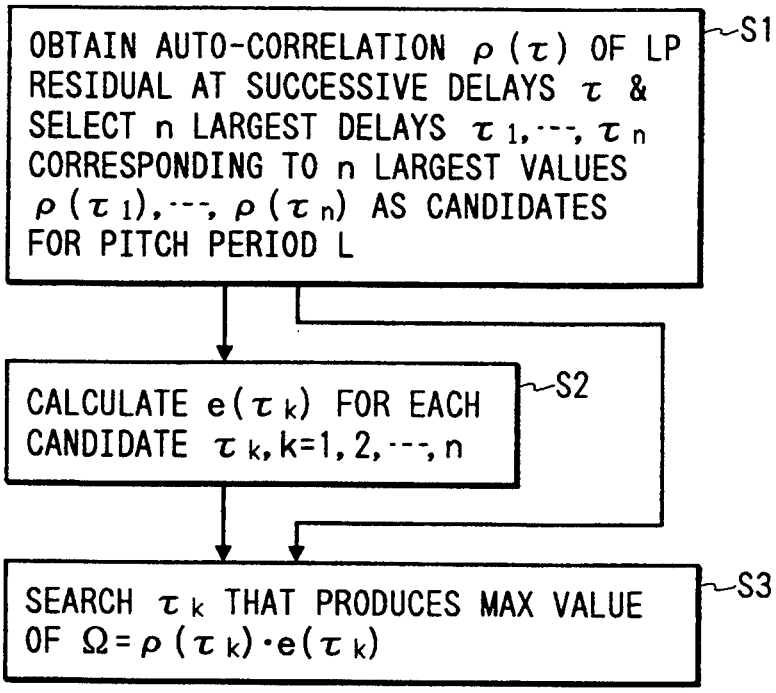
FIG. 22 is a diagram showing processing steps involved in a sixth embodiment of the present invention.

A description will be given, with reference to FIG. 22, of an improved optimum pitch period searching method.

Figure 1:
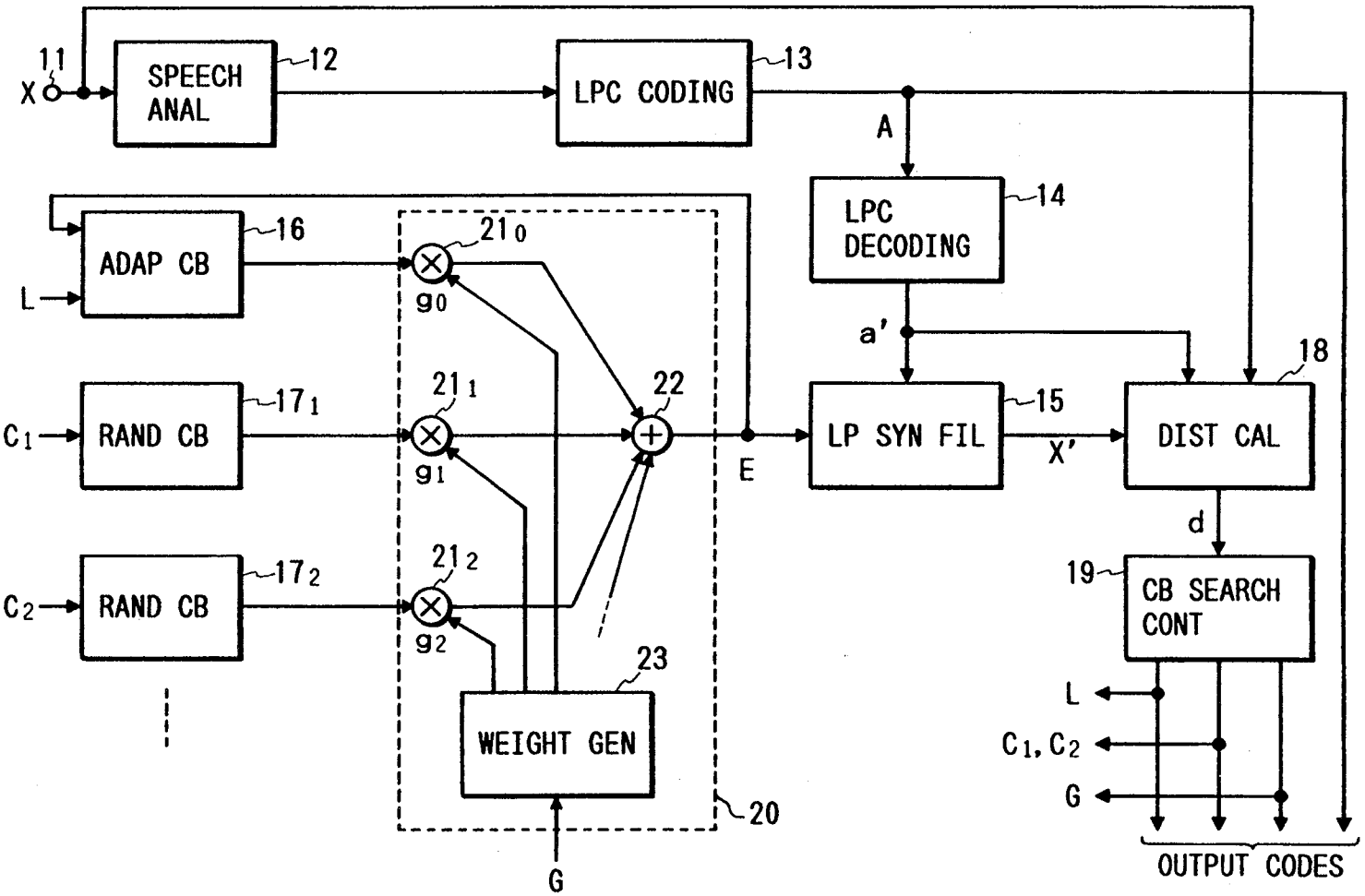
FIG. 1 PRIOR ART
FIG. 1 is a block diagram showing a general construction of a conventional linear predictive encoder.

In step S1 the periodicity of the waveform of the input speech is analyzed in the speech analysis part 1 in FIG. 1. For example, an auto-correlation $\rho(\tau)$ is obtained with the linear prediction residual signal using a window and n delays which provided largest n correlations $\rho(\tau_k)$ (k=1, . . . , n) are obtained, that is, n candidates for the pitch period and their periodicity are obtained. The lengths of the n periods are an integral multiple of the sample period of the input speech frame (accordingly, the value of each period length is an integral value), and values of auto-correlation corresponding to non-integral period length in the vicinity of these period lengths are obtained in advance by simple interpolating computation. The analysis window is selected sufficiently larger than the length of one speech frame.

In step S2 the codevector of the adaptive codebook, generated using each of the n candidates for the pitch period and the predetermined number of non-integral-value periods in the vicinity of the n candidates, is provided as the excitation vector to the synthesis filter 15 and the wave form distortion of the reconstructed speech provided therefrom is computed. Letting X represent the input vector, H an impulse response matrix, P the codevector selected from the adaptive codebook 16 (a previous excitation vector repeated with the pitch period $\tau$) and g the gain, the distortion d of the reconstructed speech from the synthesis filter 15 is usually expressed by the following equation:

$$\begin{aligned} d &= \| X - gHP(\tau) \|^2 \\ &= X^TX - 2\,gX^THP(\tau) + g^2(HP(\tau))^THP(\tau) \end{aligned} \quad (1)$$

where T indicates transposition.

Eq. (1) is partially differentiated by the gain g to determine an optimum gain g which reduces the differentiated value to zero, that is, minimizes the distortion d. Substitution of the optimum gain g into Eq. (1) gives $$d = X^TT = (X^THP(\tau))^2/HP(\tau))^THP(\tau) \quad (2)$$

Setting the second term on the right-hand side of Eq. (2)

$$e(\tau) = (X^THP(\tau))^2/HP(\tau)^THP(\tau) \quad (3)$$

to search for the pitch period $\tau$ which minimizes the distortion d is equivalent to the search for the pitch period $\tau$ which maximizes $e(\tau)$, because $X^TX$ does not vary with $\tau$. In step S2, $e(\tau)$ is computed for each of the candidates found in step S1.

In step S3, the pitch period $\tau$ is selected, based not only on the waveform distortion when the codevector of the adaptive codebook is used as the excitation signal but also on a measure taking into account the value of the auto-correlation $\rho(\tau_k)$ obtained in step S1. In this instance, only the candidate $\tau_K$ obtained in step S1 and its vicinity are searched.

For example, the search is made for the pitch period $\tau$ which maximizes the following equation:

$$\begin{aligned} \Omega &= \rho(\tau_k)e(\tau_k) \\ &= \rho(\tau_k)\,(X^THP(\tau_k))^2/HP\,(\tau_k))^THP(\tau_k) \end{aligned} \quad (4)$$

The reason for this is that the larger the values $\rho(\tau_K)$ and $e(\tau_K)$, the more desirable as the pitch period.

In the above, the denominator of Eq. (4) represents the power of the output of the synthesis filter supplied with the output from the adaptive codebook. Since it can be regarded as substantially constant even if the period $\tau$ is varied, it is also possible to sequentially preselect periods having large values of the numerator $\rho(\tau_K)(X^THP(\tau_k))^2$ and calculate Eq. (4), including the denominator, for each of the preselected periods, that is, it is possible to obtain $\Omega$. This is intended to reduce the computational complexity of the denominator of Eq. (4) since it is far higher than the computational complexity of the numerator.

Figure 23:
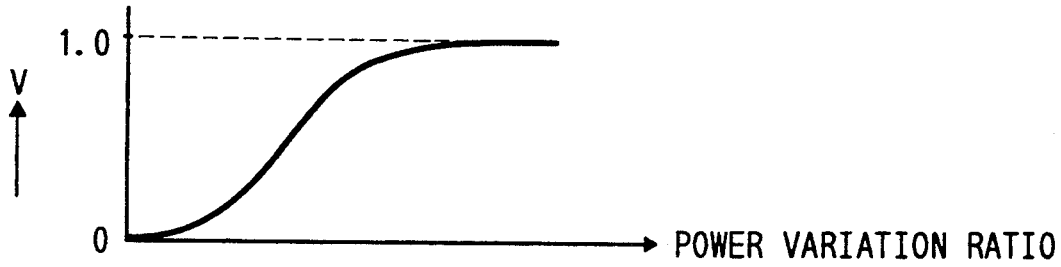
FIG. 23 is a graph showing the function V relative to power variation ratio of a speech.

The measure for selecting the pitch in step S3 can be adaptively controlled in accordance with the constancy of the speech in that speech period (or the analysis window). That is, the auto-correlation $\rho(\tau)$ is a function which depends on the mean pitch period viewed through a relatively long window. On the other hand, the term $e(\tau)$ is a function which depends on a local pitch period only in the speech frame which is encoded. Accordingly, the desirable pitch period can be determined by attaching importance to the function $\rho(\tau)$ in the constant or steady speech period and the function $e(\tau)$ in a waveform changing portion. More specifically, the variation ratio of speech power is converted to a function V taking values 0 to 1 as shown in FIG. 23, for instance, and the ratio of contribution to $\Omega$ between the functions $\rho(\tau)$ and $e(\tau)$ is controlled in accordance with the function V, with $\Omega$ set as follows:

$$\Omega = \rho(\tau)^{(1-V)}.e(\tau)^V$$

The function V is selected so that it increases with an increase in the speech power variation ratio.

As described above, according to this embodiment, it is possible to obtain the pitch period which is most desirable to the output vector of the random codebook, in step S3, by taking into account both the distortion of the waveform synthesized only by the codevector of the adaptive codebook and the periodicity analyzed in step S1. This permits the determination of the pitch period to be more correct or accurate than that obtainable with the method which merely limits the number of candidates for the pitch periods in step S1. In other words, the waveform distortion can be reduced. Besides, it is possible to suppress an increase of the distortion which comes from the reduction of the number of candidates for the pitch period in step S1, and hence the computational complexity can be reduced as well.

Embodiment 7

As a method for efficiently quantizing an arbitrary waveform as of a speech or picture signal, there has been widely used a vector quantization method which handles, as a unit, a vector composed of plural samples, such as the codevector of the random codebook in FIG. 1. In such an instance, since it is inefficient to prepare reference vectors for all waveform portions of the signal waveform to be quantized which are similar in shape but different in amplitude, a gain-shape quantization method which quantizes the signal waveform in pairs of shape and gain vectors is usually employed. In FIG. 1, codevectors are held, as shape vectors, in the random codebooks $\mathbf{17}_1$ and $\mathbf{17}_2$, for example, and a selected one of such shape vectors in each random codebook and weights (gains) $g_1$ and $g_2$ which are provided to the multiplication parts $\mathbf{21}_1$ and $\mathbf{21}_2$ are used to vector quantize a random component of the input speech waveform.

Such a gain-shape vector quantization method is constituted so that, in the selection of a quantization vector (a reference shape vector) of the smallest distance to the input waveform, one of the shape vectors (i.e., codevectors) stored in the shape vector codebook (i.e., the random codebook) 17 is selected and is multiplied by a desired scalar quantity (gain) g in the multiplication part 21 to provide the shape vector with a desired amplitude. Thus, the input waveform is represented (i.e. quantized)

by a pair of codes, i.e. a code corresponding to the shape vector and the code of the gain.

Figure 2:
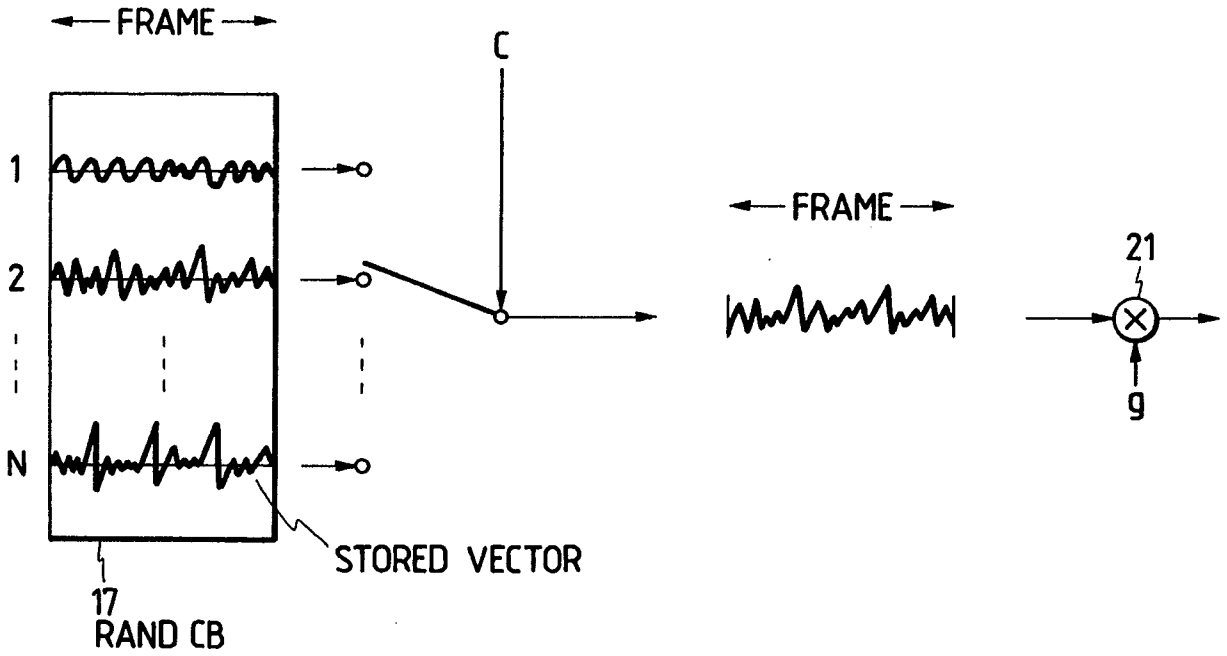
FIG. 2 PRIOR ART
FIG. 2 is a diagram showing a random codebook for use in conventional CELP coding.

There is a case where it is effective to employ a gain-shape vector quantization method which expresses the input vector by quantization with the code C of the shape vector and the code of the gain g for multiplying the shape vector, as shown in FIG. 2, through a tradeoff with the computational complexity or memory requirement. With this method, since all samples of the shape vector need only be multiplied by one gain parameter, the waveform distortion may sometimes become large in the case where the number of dimensions of the shape vector is large or the amplitude of the input vector undergoes a substantial change in the vector. Next, a description will be given of an embodiment which employs an amplitude envelope separated vector quantization method which quantizes a signal in units of vectors, with a minimum quantity of information involved and with the smallest possible waveform distortion.

Figure 24:
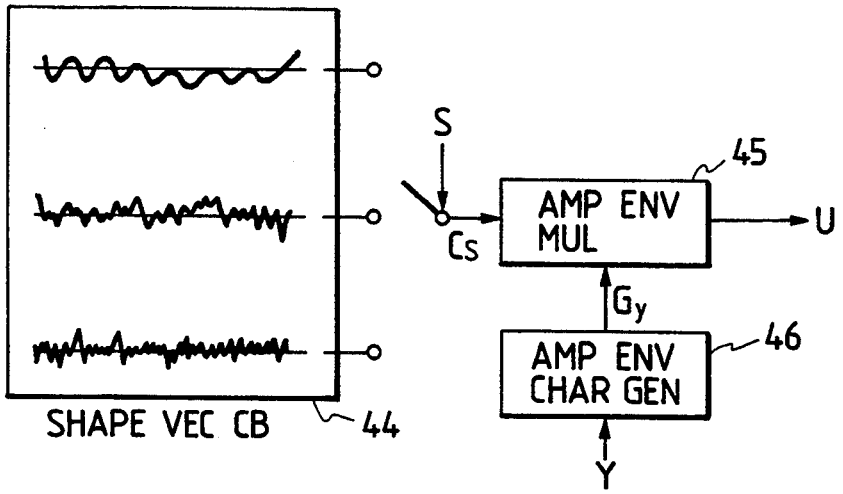
FIG. 24 is a diagram for explaining a gain-shape vector quantization in a seventh embodiment of the present invention.

FIG. 24 illustrates a basic process which is applied to the above-said embodiment. A reference shape vector Cs, selected from a shape vector codebook 44 having a plurality of reference shape vectors Cs each represented by a shape code S, is provided to a multiplication part 45. On the other hand, an amplitude envelope characteristic generation part 46 generates an amplitude envelope characteristic Gy corresponding to an amplitude characteristic code Y provided thereto, and the amplitude envelope characteristic Gy thus created is provided to the multiplication part 45. The amplitude envelope characteristic Gy is a vector which has the same number of dimensions (the number of samples) as does the shape vector Cs. In the multiplication part 45, corresponding elements of the reference shape vector Cs and the amplitude envelope characteristic Gy are multiplied by each other, and the multiplied results are output as a reconstructed vector U. The shape vector codebook 44 has a plurality of pairs of reference shape vectors Cs and codes S.

Figure 25:
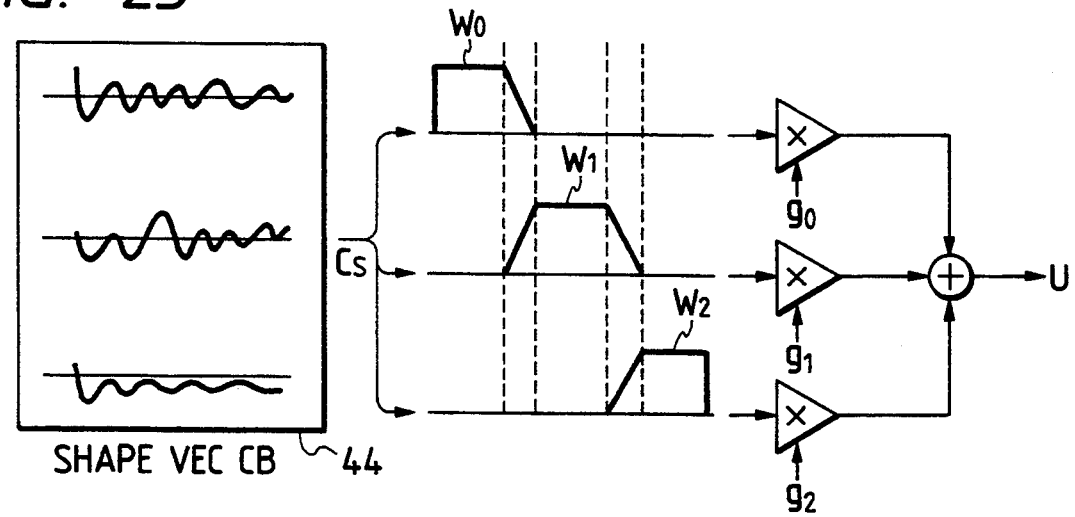
FIG. 25 is a diagram for explaining an amplitude envelope separated vector quantization method.

FIG. 25 shows examples of comprehensive features of the multiplication part 45 and the amplitude envelope characteristic generation part 46 in FIG. 24. A reference shape vector Cs selected from the shape vector codebook 44 is separated into front, middle and rear portions of the shape vector, using three amplitude envelope characteristic window functions $W_0$, $W_1$ and $W_2$, and the separated portions are multiplied by the gains $g_0$, $g_1$ and $g_2$, respectively. The multiplication results are added together and the added result is output as the reconstructed vector U. Such window functions $W_0$, $W_1$ and $W_2$ are each expressed by a vector of the same number of dimensions as that of the vector Cs. Hence, letting U(i), W(i), Cs(i), and Gy(i) represent $i^{th}$ element of the vectors U, W, Cs and Gy, respectively, they can be expressed by $$\begin{aligned} U(i) &= Cs(i)\{g_0W_0(i) + g_1W_1(i) + g_2W_2(i)\} \\ &= Cs(i)Gy(i) \end{aligned}$$

This means that it is possible to determine the amplitude envelope characteristic Gy having the same function as that in FIG. 24. By prefixing the window functions $W_0$, $W_1$ and $W_2$ and selecting a set of gains $g_0$, $g_1$ and $g_2$ (the gain vector) from a gain codebook (not shown), gains for the three different portions of the shape vector Cs in the time-axis direction can be controlled. The number of elements of the gain vector is three in this example but it needs only to be two or more and smaller than the number of dimensions of the shape vector. When the number of elements of the gain vector is the same as the number of dimensions of the shape vector, the reconstructed vector may be expressed simply by the products of corresponding elements of the shape vector and the amplitude envelope vector.

Figure 26:
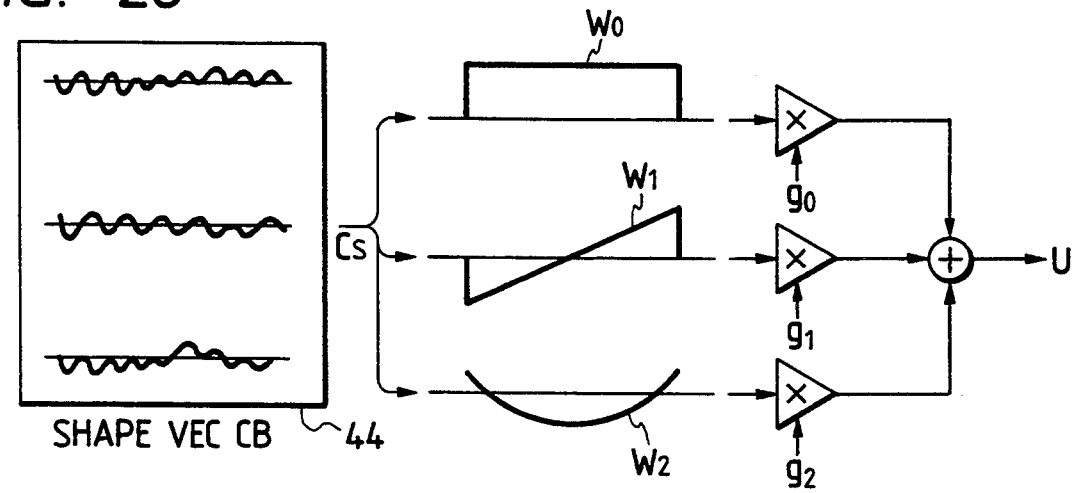
FIG. 26 is a diagram illustrating another embodiment employing the amplitude envelope separated vector quantization method.

FIG. 26 shows other examples of the comprehensive features of the multiplication part 45 and the amplitude envelope characteristic generation part 46, the amplitude envelope characteristic being expressed by a quadratic polynomial. The window functions $W_0$, $W_1$ and $W_2$ represent a constant, a first order term and a second order term of the polynomial respectively. The elements $g_0$, $g_1$ and $g_2$ of the gain vector are zero-order, first-order and second-order polynomial expansions coefficients of the amplitude envelope characteristic, respectively. That is, the element $g_0$ represents the gain for the constant term, $g_1$ the gain for the first-order variable term and $g_0$ the gain for the second-order variable term. Also in the case of FIG. 26, i-th element of the reconstructed vector can be expressed by U(i)=Cs(i)Gy(i), and hence can be implemented by the construction shown in FIG. 24.

In the case of FIG. 26, the amplitude envelope characteristic is separated by modulation with orthogonal polynomials, the gains are multiplied independently, and all the components are added together, whereby the reconstructed vector is obtained. The use of the orthogonal polynomials is not necessarily required to synthesize the reconstructed vector but is effective in obtaining the optimum gain vector g as in the case of training a gain codebook. In the case of training the gain codebook using training samples of speech, the codevector of the gain g has to be obtained as a solution of simultaneous equations, but the modulation by the orthogonal polynomials enables non-diagonal terms of the equations to be approximated to zero, and hence facilitates obtaining the solution.

Figure 27:
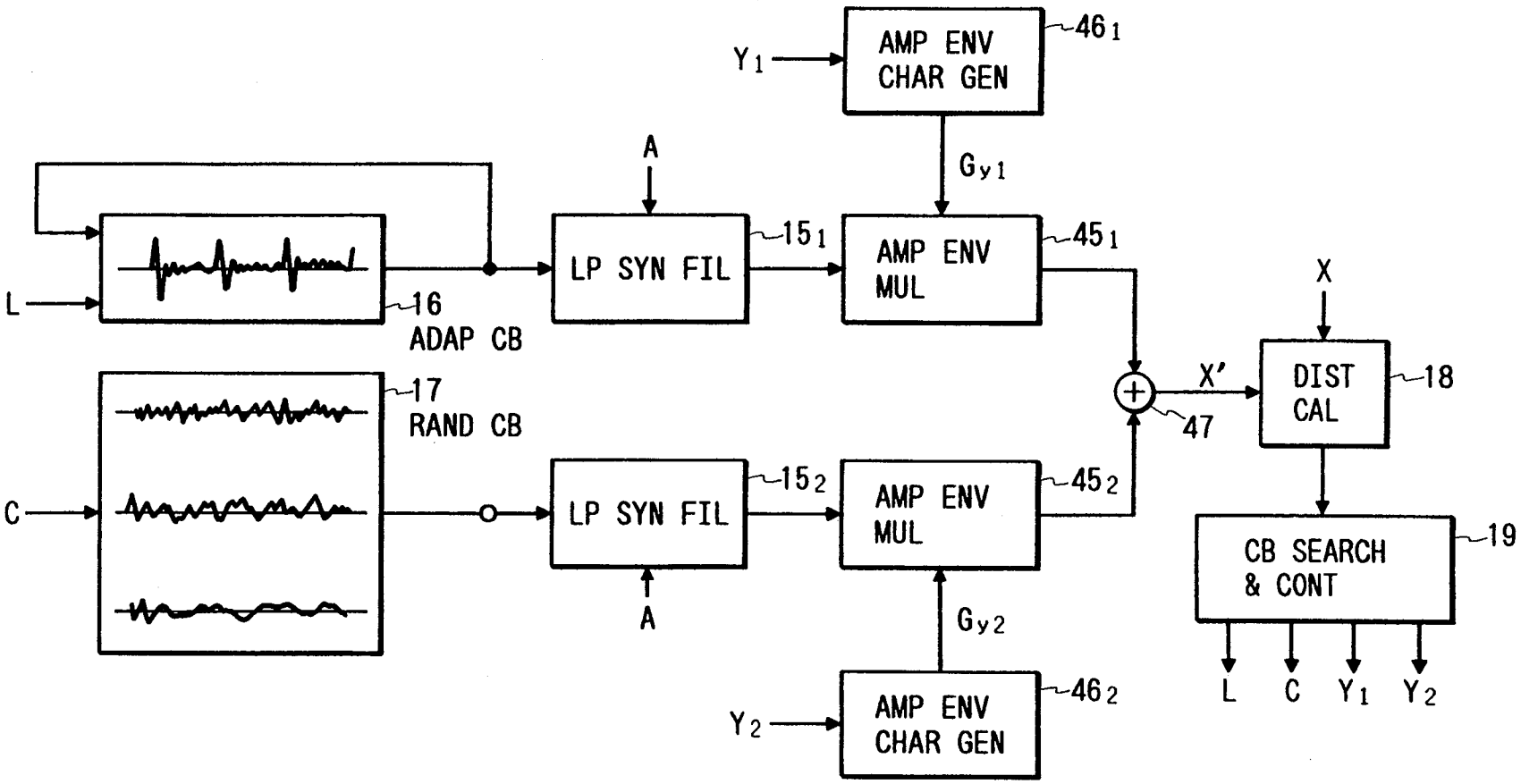
FIG. 27 is a diagram illustrating an embodiment which uses the amplitude envelope separated vector quantization method for speech coding.

FIG. 27 illustrates in block form an embodiment in which the vector quantization method utilizing the above-mentioned amplitude envelope characteristic is applied to speech signal coding. As in the case of FIG. 1, the codevector output from the adaptive codebook 16 and the codevector output from the random codebook 17 are provided as excitation vectors to LPC synthesis filters $\mathbf{15}_1$ and $\mathbf{15}_2$, the reconstructed outputs of which are provided to amplitude envelope multiplication parts $\mathbf{45}_1$ and $\mathbf{45}_2$, respectively in each of the LPC synthesis filters $\mathbf{15}_1$ and $\mathbf{15}_2$ there is set the LPC parameters A from the speech analysis part as in the case of FIG. 1. Amplitude envelope characteristic generation parts $\mathbf{46}_1$ and $\mathbf{46}_2$ generate amplitude envelope characteristics $Gy_1$ and $Gy_2$ based on parameter codes $Y_1$ and $Y_2$ provided thereto and supply them to the amplitude envelope multiplication parts $\mathbf{45}_1$ and $\mathbf{45}_2$. Each codevector for each frame is provided as an excitation vector to each of the synthesis filters $\mathbf{15}_1$ and $\mathbf{15}_2$, the reconstructed outputs of which are input into the amplitude envelope multiplication parts $\mathbf{45}_1$ and $\mathbf{45}_2$, wherein they are multiplied by the amplitude envelope characteristics $Gy_1$ and $Gy_2$ from the amplitude envelope characteristic generation parts $\mathbf{46}_1$ and $\mathbf{46}_2$, respectively. The multiplied outputs are accumulated in an accumulation part 47, the output of which is provided as the reconstructed speech vector X'. The amplitude envelope characteristics $Gy_1$ and $Gy_2$ are each constructed, for instance, as the products of the window functions $W_0$, $W_1$, $W_2$ and the gain $g_0$, $g_1$, $g_2$ in FIGS. 25 and 26.

In the case of constructing the speech encoder through use of the above-mentioned amplitude envelope separated vector quantization method, the distortion of the reconstructed speech X' relative to the input speech X is calculated in the distortion calculation part 18, and the pitch period L, the random code C and amplitude characteristic codes $Y_1$ and $Y_2$ which minimize the distortion are determined by the codebook search control part 19. In the decoder reconstructed vectors, which are obtained by the products of output vectors of the adaptive codebook and the random codebook obtainable and the amplitude envelope characteristics $Gy_1$, $Gy_2$ from the codes L, C and $Y_1$, $Y_2$, are accumulated and provided to the synthesis filter to yield the reconstructed speech.

As described above, in these embodiments the reconstructed vector U is expressed by the product of the shape vector Cs of a substantially flat amplitude characteristic and a gentle amplitude characteristic Gy specified by a small number of parameters, and a desired input vector is quantized using the codes S and Y representing the shape vector Cs and the amplitude characteristic Gy. Accordingly, in the encoder, when the window function is fixed, the code Y which specifies the gain vector ($g_0$, $g_1$, $g_2$) which is a parameter representing the amplitude envelope characteristic and the code S which specifies the shape vector Cs of a substantially flat amplitude characteristic are determined by referring to each codebook.

On the other hand, the decoder outputs the reconstructed vector U obtained as the product of the shape vector Cs and the amplitude envelope characteristic Gy obtainable from respective codes determined by the encoder. With this method, the quantization distortion can be made smaller than that obtainable with the gain-shape vector quantization method used in other embodiments in which the codevector of the random codebook and the scalar value of the gain g are used to express the reconstructed vector as shown FIG. 2. That is, the signal can be quantized in units of vector with a minimum quantity of information involved and with the smallest possible distortion. This method is particularly effective when the number of dimensions of the vector is large and when the amplitude envelope characteristic undergoes a substantial change in the vector.

Although in the FIG. 27 embodiment the outputs of the adaptive codebook 16 and the random codebook 17 are shown to be applied directly to the LPC synthesis filters $15_1$ and $15_2$ prior to their accumulation, only one synthesis filter may be provided at the output side of the accumulation part 47 as in the other embodiments. Conversely, the synthesis filter 15 provided at the output side of the accumulation part 47 may be provided at the output side of each of the adaptive codebook 16 and the random codebook 17 in the embodiments described above and those described later on.

Embodiment 8

Figure 28:
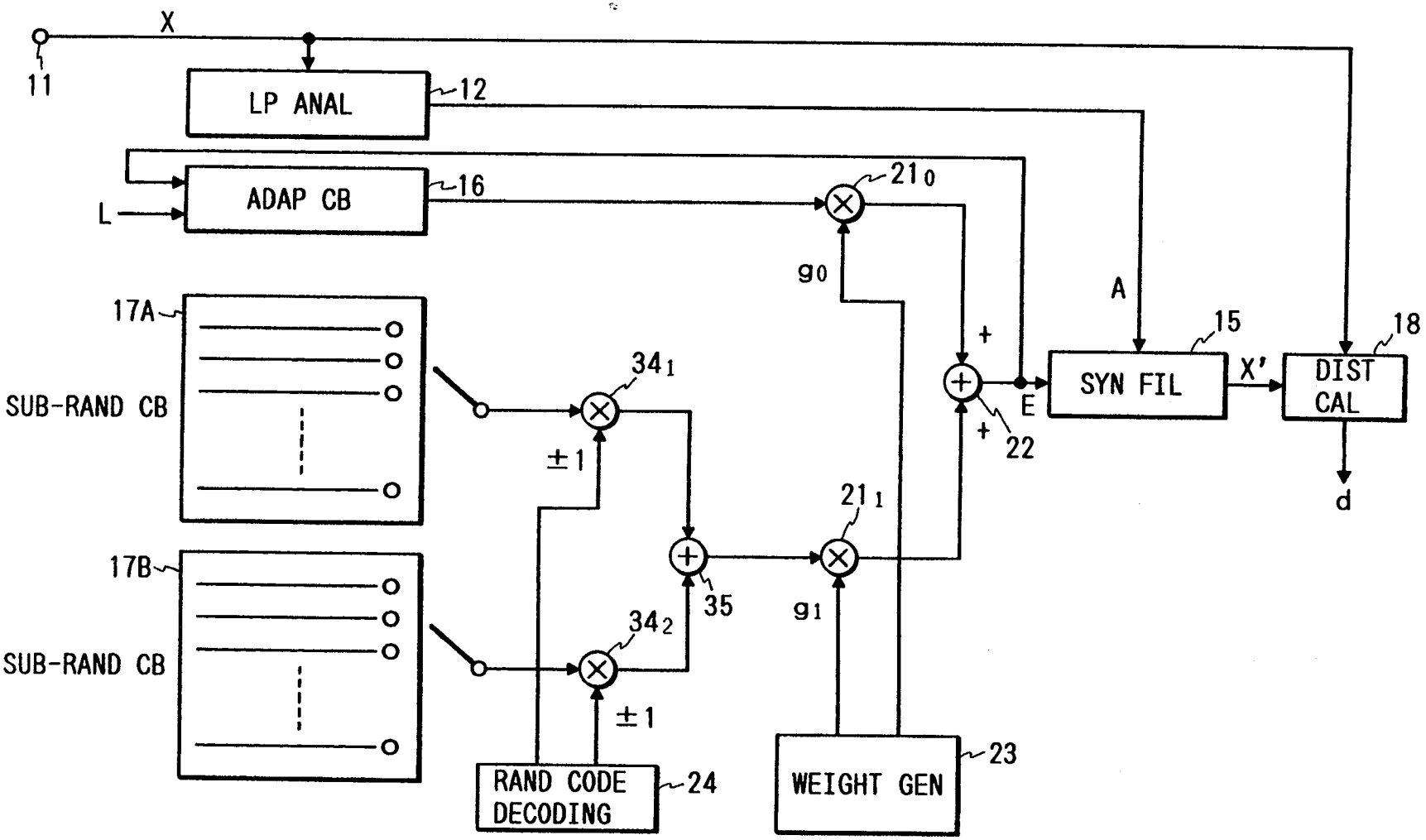
FIG. 28 is a block diagram illustrating the principal part of an arrangement for excitation signal coding use in an eighth embodiment of the present invention.

The forgoing description has been given of various embodiments of speech coding and decoding which are applied to the CELP or VSELP method. In the case of utilizing 4096 ($=2^{12}$) different codevectors, including positive and negative polarities, the CELP method calls for prestoring 2048 vectors in the random codebook, while the VSELP method needs only 12 stored vectors (basis vectors) to generate the 4096 different codevectors. With the CELP method, a speech of good quality can be decoded and reconstructed as compared with that by the VSELP method, but the number of prestored vectors is so large that it is essentially difficult to design them by training. On the other hand, according to the VSELD method, the number of prestored vectors (basis vectors) is so small that it is possible, in practice, to design them by training, but the quality of the reconstructed speech is inferior to that obtainable with the CELP method. FIG. 28 illustrates in block form an embodiment of a speech coding method which is a compromise or intermediate between the two methods, guarantees the reconstructed speech quality to some extent and calls for only a small number of prestored vectors. In this embodiment, the random codebook 17 in the conventional encoder of FIG. 1 is formed by the sub-random codebooks 17A and 17B, from which sub-codevectors are read out, the read-out sub-codevectors are provided to the multiplication parts $34_1$ and $34_2$, wherein their signs are controlled, and they are accumulated in the accumulation part 35, thereafter being output. This embodiment is identical in construction with the encoder of FIG. 1 except for the above. In the interests of brevity and clarity, there are omitted from FIG. 28 the LPC parameter coding part 13 and the LPC parameter decoding part 14 shown in FIG. 1.

The input speech X provided to the terminal 11 is provided to the LPC analysis part 12, wherein it is subjected to LPC analysis in units of frames to compute the predictive coefficients A. The predictive coefficients A are quantized and then transmitted as auxiliary information and, at the same time, they are used as coefficients of the LPC synthesis filter 15. The output vector of the adaptive codebook 16 can be determined by determining the pitch period in the same manner as in the case of FIG. 1. On the other hand, the sub-codevectors read out from each sub-random codebooks 17A and 17B are each multiplied by the sign value $+1$ or $-1$, thereafter being accumulated in the accumulation part 35. Its output is applied as the excitation vector E to the LPC synthesis filter 15. Combinations of two vectors and two sign values which minimize the distortion d of the reconstructed speech X' obtained from the synthesis filter 15, relative to the input speech X, are selected from the sub-random codebooks 17A and 17B while taking into account the output vector of the adaptive codebook.

Next, a set of optimum gains $g_0$ and $g_1$ for the output vector thus selected from the adaptive codebook 16 and the vector from the accumulation part 35 is determined by searching the gain codebook 23. Incidentally, as shown in FIG. 29, a method which uses a random codebook which has only one excitation channel corresponds to the CELP method, and a method in which the number of channels forming the random codebook is equal to the number of bits allocated, B, and each sub-random codebook has only one basis vector corresponds to the VSELP method. This embodiment contemplates a coding method which is intermediate between the CELP method and the VSELP method. Although FIG. 28 shows an example which employs two channels of random codevector to be selected, the number of channels is not limited specifically thereto but an arbitrary number of system can be selected within the range of 1 to B. FIG. 29 compares number of channels, K, number of vectors, N, in each channel and total number of vectors, S, among CELP, VSELP and intermediate schemes including the embodiment of FIG. 28, where it is assumed that the respective channels have the same number of bits, but an arbitrary number of bits can be allocated to each channel as long as the total number of bits allocated to each channel is B.

Figure 30:
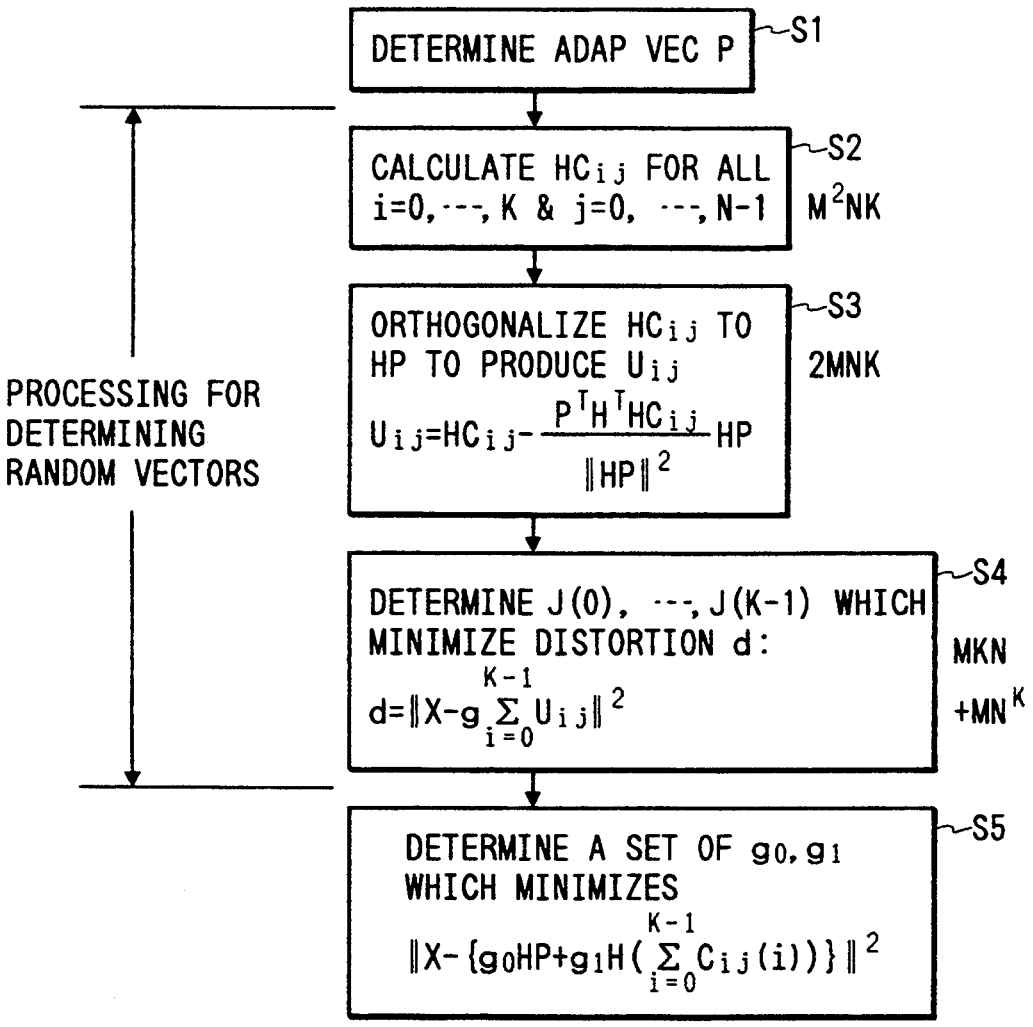
FIG. 30 is a flowchart showing a procedure for determining an optimum random code in FIG. 28.

FIG. 30 shows processing for selecting random codevectors of the sub-random codebooks 17A and 17B in such a manner as to minimize the distortion of the synthesized speech.

In step S1 an output vector P of the adaptive codebook 16 is determined by determining the pitch period L in the same manner as in the case of FIG. 1.

In step S2 a sub-codevector $C_{ij}$ ($i=0, \ldots, K-1$, $j=0, \ldots, N_i-1$, K being an integer equal to or greater than 2 and representing the number of sub-random codebooks, $N_i$ being an integer which represents the number of vectors of an $i^{th}$ sub-random codebook) of each of the sub-random codebooks 17A and 17B is provided to the synthesis filter 15 to create $HC_{ij}$, where H is an impulse response matrix. In the case of employing the processing for making the random codevectors repetitious as in the first embodiment, however, it is assumed that $C_{ij}$ represents the random codevectors made repetitious.

In the case of encoding the input speech vector by use of a combination of the adaptive codevector P and the codevector of the random codebook, a component parallel to the adaptive codevector P of the adaptive codebook, contained in the codevector of random codebook, is removed (orthogonalization) at the output of the synthesis filter 15 so as to search an optimum codevector of the random codebook, taking into account the output vector P, as is well-known in the art. To this end, in step S3, each $HC_{ij}$ is orthogonalized with respect to each HP to provide $U_{ij}$ as expressed by the following equation:

$$U_{ij}=HC_{ij}-(P^TH^THC_{ij}HP)/\|HP\|^2 \tag{5}$$

where T indicates a transposed matrix.

Next, in step S4 the distortion d between the input vector X and $U_{ij}$ is obtained by the following equation:

$$d = \|X - g\sum_{i=0}^{K-1} U_{ij}\|^2 \tag{6}$$

and sets of codes J(i), $i=0, 1, \ldots, K-1$, corresponding to the respective sub-random codebooks, which minimize the distortion d, are determined.

After this, in step S5 the thus determined codes J(O) to J(K−1) are used to determine the sum of gains $g_0$ and $g_1$ which minimizes the following equation:

$$\|X - \left\{g_0HP + g_1H\left(\sum_{i=0}^{K-1} C_{ij(i)}\right)\right\}\|^2 \tag{7}$$

where the vectors are all assumed to be M-dimentional. The numbers of computations needed in steps S2, S3 and S4 in FIG. 30 are shown at the right-hand side of their blocks.

In the case where the number of bits, B, allocated to the encoding of the random component is, for example, 12 in the orthogonalization in the speech encoding depicted in FIG. 30, the total number of vectors needed in the two sub-random codebooks is also 64 in the embodiment of FIG. 28, as is evident from the table shown in FIG. 29; so that the orthogonalization by Eq. (1) can be performed within a practical range of computational complexity. In the conventional CELP method, however, the number of codebook vectors corresponding to 11 bits except the sign bit is as large as $2^{11}$, which leads to enormous computational complexity, making real-time processing difficult.

Even in the FIG. 28 embodiment, if the number $N_i$ of random codevectors in each sub-random codebook is increased, then the computational complexity necessary for the orthogonalization in the vector determining method in FIG. 30 increases accordingly, and the necessary processing time also increases, but the computational complexity can be reduced through use of such a procedure as mentioned below. The distance calculation step S4 in FIG. 30, that is, Eq. (6) is expanded as follows.

$$\begin{aligned} d &= \|X - g\sum_{i=0}^{K-1} U_{ij}\|^2 \\ &= X^tX - 2gX^T\sum_{i=0}^{K-1} U_{ij} + g^2\|U_{ij}\|^2 \end{aligned} \tag{8}$$

In the above, K is the number of channels of the random codebooks, M is the number of dimensions of vectors and N is the number of vectors per channel of the random codebook. The gain g is quantized after determination of the excitation vector, and hence is allowed to take an arbitrary value. The value of gain g is determined which renders the partial differentiation of Eq. (8) with respect to the gain g, and substituting the value of the gain g into Eq. (8), $d=X^TX-\theta$ is obtained, where $\theta$ is expressed by the following equation:

$$\theta = \left(X^T\sum_{i=0}^{K-1} U_{ij}\right)^2 / \|\sum_{i=0}^{K-1} U_{ij}\|^2 \tag{9}$$

Thus, the minimization of the distortion d is equivalent to the maximization of the $\theta$. The computation of the $\theta$ involves MNK sum-of-products calculations for the inner product of the numerator of the $\theta$ and $MN^k$ sum-of-products calculations for the computation of the energy of the denominator, besides calls for $N^k$ additions, subtractions, divisions and comparisons. In addition, about $M^2NK$ sum-of-products calculations are needed in the synthesis step S2 and about 2 MNK sum-of-products calculations are also needed in the orthogonalization step S3. Incidentally, HP necessary for the computation of $U_{ij}$ is obtained at the time of determining the periodic component vector P in the adaptive codebook, and hence is not included in this computational complexity.

For the sake of brevity, a description will be given of the case where K=2, in particular. In the case of K=1, that is, in the case of the CELP method, the processing method mentioned herein is not so advantageous, and in the case of K=B, that is, in the case of the VSELP method, the processing method cannot be used; hence, this embodiment is not applied to both of them. The $\theta$ is rewritten as follows, with K=2:

$$\theta=(X^TU_{0j}+X^TU_{1j})^2/\|U_{0j}+U_{1j}\|^2 \tag{10}$$

In the case where B=12 and five bits except sign bit are allocated to each channel, $N=2^{(12/2)-1}=2^5=32$. The number of sum-of-products calculations of the numerator in this case is 64M, whereas the calculation of the energy of the denominator needs 1024M computations. Therefore, the computational complexity can be reduced by preselecting a plurality of vectors in descending order of values beginning with the largest obtained only by the inner product calculation of the numerator and calculating the energy of the denominator for only the small number of such preselected candidates. Substituting D in the parentheses on the term of the numerator in Eq. (10) and setting the respective inner product terms in the parentheses to $d_{0j}$ and $d_{1j}$, the following equations are obtained:

$$D=X^TU_{0j}+X^TJ_{1j}=d_{0j}+d_{1j} \quad (11)$$

$$d_{0j}=X^TH\{C_{0j}-(P^TH^THC_{0j}P)/\|HP\|^2\} \quad (12)$$

$$d_{1j}=X^TH\{C_{1j}-(P^TH^THC_{1j}P)/\|HP\|^2\} \quad (13)$$

Figure 31:
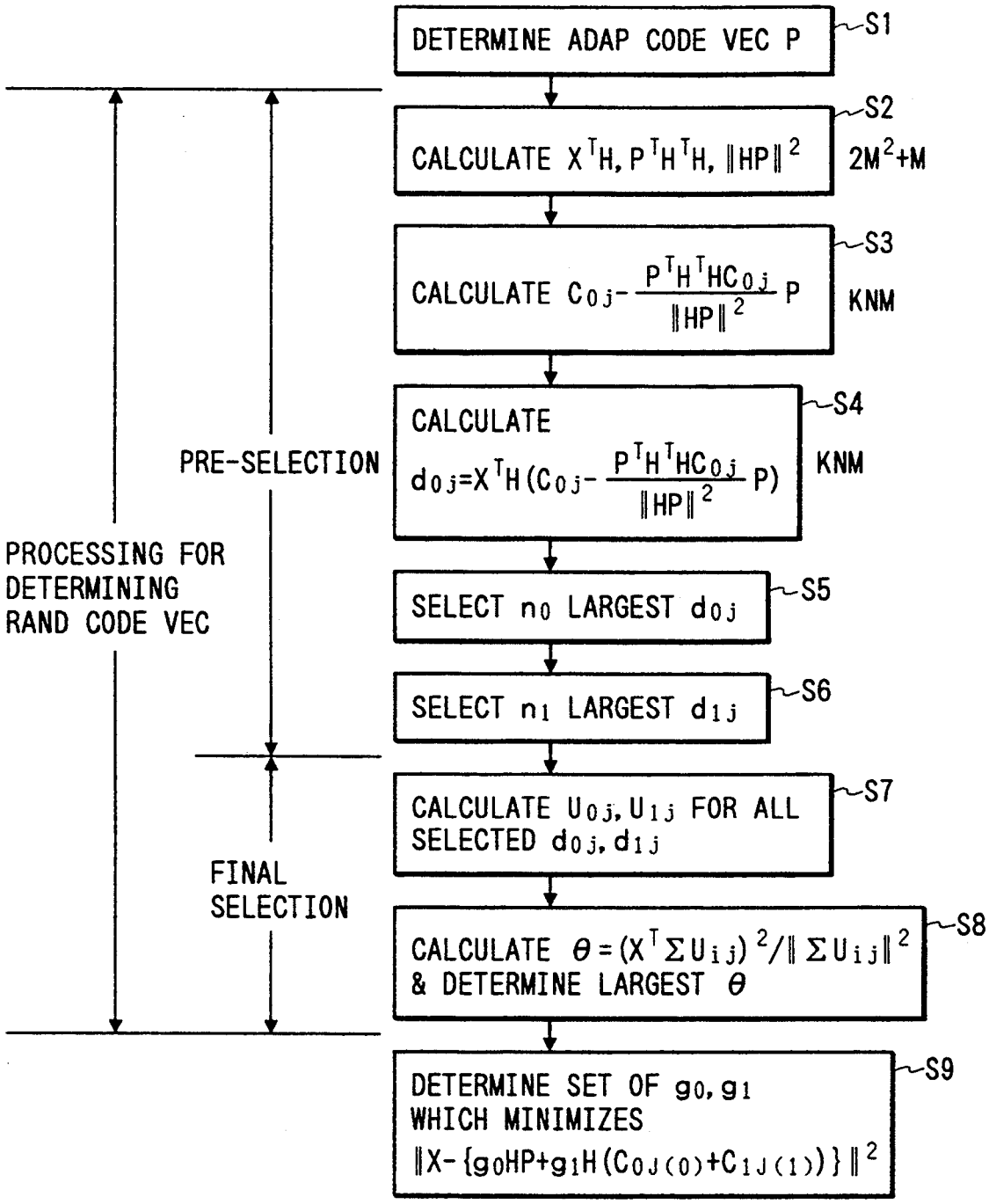
FIG. 31 is a flowchart showing a procedure for determining a random codevector.

In the above, H is a matrix, and hence the synthesis computation of HC calls for many calculations. As will be seen from Eqs. (12) and (13), however, if $X^TH$, $P^TH^TH$ and $\|HP\|$ are precomputed only once for the calculation of D, then there will be no need of conducting the synthesis computation (convolution of the filter) HC for a number of Cs. This technique is used to rapidly calculate the inner products $d_{0j}$ and $d_{1j}$ for each channel. In each channel a predetermined number of candidates are selected in descending order of the inner product beginning with the largest, and combinations of a small number of selected vectors are used to select the vector which maximize Eq. (10), that is, ultimately minimizes the distortion. This calculation procedure is shown in FIG. 31.

Step S1: The adaptive codevector P is determined. At this time, HP is calculated.

Step S2: Next, $X^TH$, $P^TH^TH$, $\|HP\|^2$ are calculated.

Step S3: Next, for the vector $C_{0j}$ of one of the sub-random codebooks, $C_{0j}-(P^TH^THC_{0j}P)/\|HP\|^2$ is calculated.

Step S4: Further, $d_{0j}=X^TH\{C_{0j}-(P^TH^THC_{0j}P)/\|HP\|^2\}$ is calculated.

Step S5: n largest inner products $d_{0j}$ are selected.

Step S6: Similarly, $d_{1j}$ is calculated for the vector $C_{1j}$ of the other sub-random codebook, and n largest inner products $d_{1j}$ are selected.

Step S7: $U_{0j}$ and $U_{1j}$ are calculated only for vectors $C_{0j}$ and $C_{1j}$ for the selected 2 n inner products $d_{0j}$ and $d_{1j}$.

Step S8: The vectors $C_{0j}$ and $C_{1j}$ which maximize the value $\Omega$ of Eq. (4), including denominator $\|U_{0j}+U_{1J}\|^2$, is searched for.

Step S9: For $C_{0j(0)}$ and $C_{1j(j)}$, a pair of $g_1$ and $g_2$ which minimizes $\|X-\{g_1HP+g_2H(C)_{0j(0)}+C_{1j(j)}\}\|^2$ is determined.

The calculations of $X^TH$, $P^TH^TH$ and $\|HP\|^2$ for K, in general, require $M^2+M^2+M$ sum-of-products calculations, the calculation of $P^TH^THC$ requires KMN sum-of-products calculations and the calculation of $d_{ij}$ requires KMN sum-of-products calculations. Moreover, sorting for selecting n from N must also be done K times. The above is the preselection, and the distance calculation is to be conducted with a reduced number of vectors of the random codebook.

Wile in the above the impulse response matrix H is used as the transfer function of the synthesis filter, it is also possible to employ a transfer function which provides a filter operation equivalent to that by the impulse response matrix H.

As described with respect to the above embodiment, it is possible to make the inner product calculation for each channel in the distance calculation step S9 without performing any synthesis filter computation for a number of random codevectors. Further, since the energy calculation is made for only the candidates selected by the inner product calculations, the computational complexity can be reduced substantially.

In the case where M=80, K=2 and N=32, a rough estimate of the computational complexity for the preselection is a few tenths of the computational complexity for the final selection. On the other hand, since the quantity of computation for the final selection is composed of the quantity of computation proportional to the number of random codevectors and the quantity of computation proportional to the square or more of the number of random codevectors, a decrease in the number of candidates by the preselection will reduce the computational complexity in excess of a value proportion thereto. For example, if the number of random codevectors is reduced down to $\frac{1}{4}$ by the preselection, the computational complexity including that of the preselection as well will decrease to $\frac{1}{4}$ or less. Even in this instance, an increase in the distortion is little and a difference in the signal-to-noise ratio (SN ratio) of the output speech which is ultimately produced is less than 0.5 dB.

Embodiment 9

Figure 32:
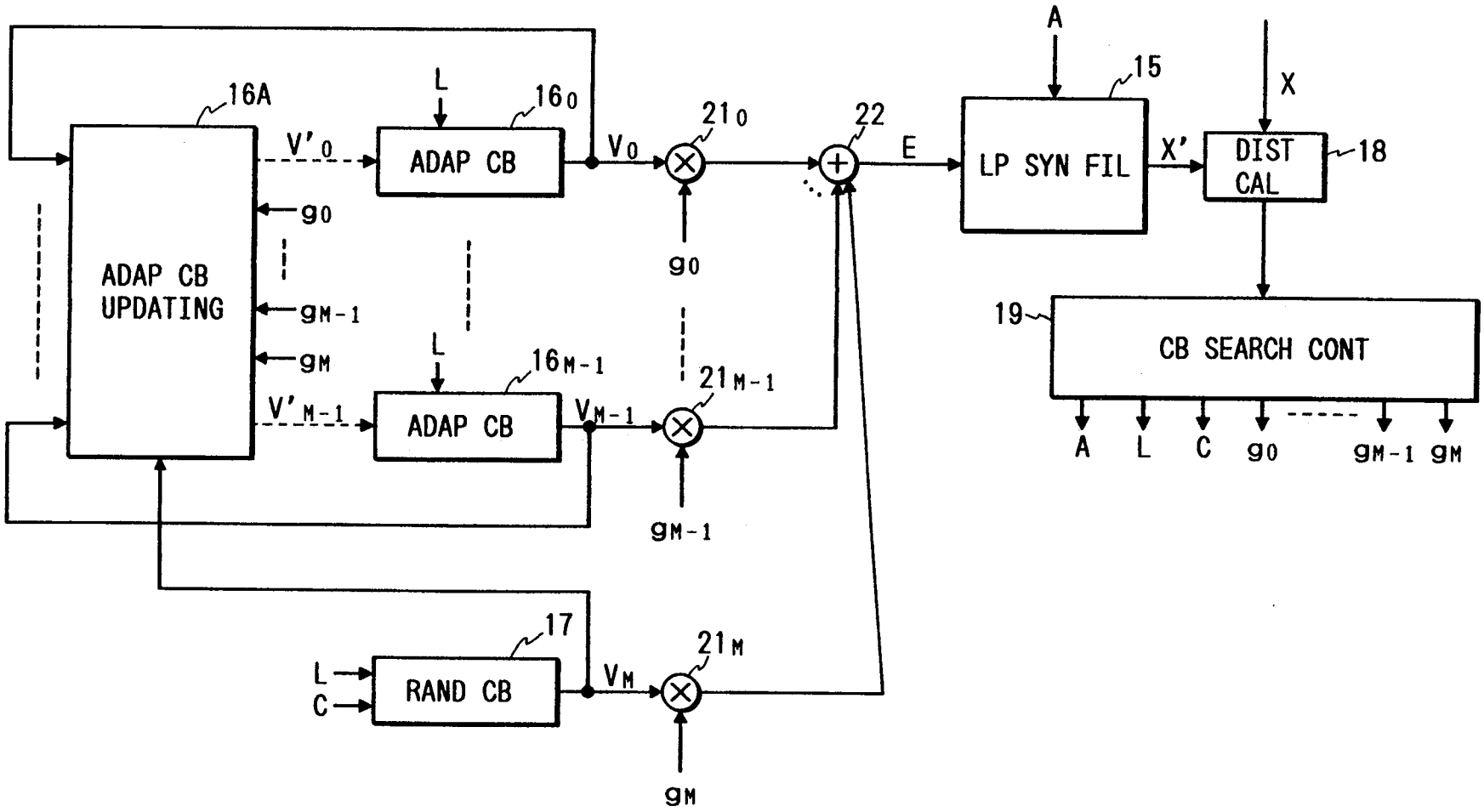
FIG. 32 is a block diagram illustrating a ninth embodiment of the present invention.

In the foregoing embodiments, as shown in FIG. 1, the previous excitation signal is cut out from the adaptive codebook 16 by the length of the pitch period L and the cut-out segment is repeatedly concatenated to one frame length. With one adaptive codebook constructed from the excitation signal E, if the waveform in the current frame differs from that in the previous frame, it is impossible to construct a vector faithful to the current frame. FIG. 32 illustrates an embodiment of the invention improved in this point. In this embodiment, the excitation vector E is synthesized by a weighted sum of a total of M+1 codevectors composed of codevectors $V_i$ (i= 0, . . . , M−1) from M adaptive codebooks $\mathbf{16}_0$ to $\mathbf{16}_{M-1}$ and codevectors $V_M$ of the random codebook 17. The excitation vector E is provided to the LPC synthesis filter 15 to synthesize (i.e. decode) a speech, and in a distortion minimization control part 19 the pitch period L, the random code C and gains $g_0, \ldots, g_{M-1}, g_M$ of respective codevector $V_0, \ldots, V_{M-1}, V_M$ are determined so that the weighted waveform distortion of the synthesized speech waveform X' relative to the input speech X is minimized. The adaptive codebooks $\mathbf{16}_i$ (i=0, . . . , M−1) are updated for each frame in an adaptive codebook updating part 16A using the adaptive codevector $V_i$ (i=0, . . . , M−1) and the random code vector $V_M$ of the previous frame and the gains $g_1, \ldots, g_{M-1}, g_M$ for them.

Figure 33:
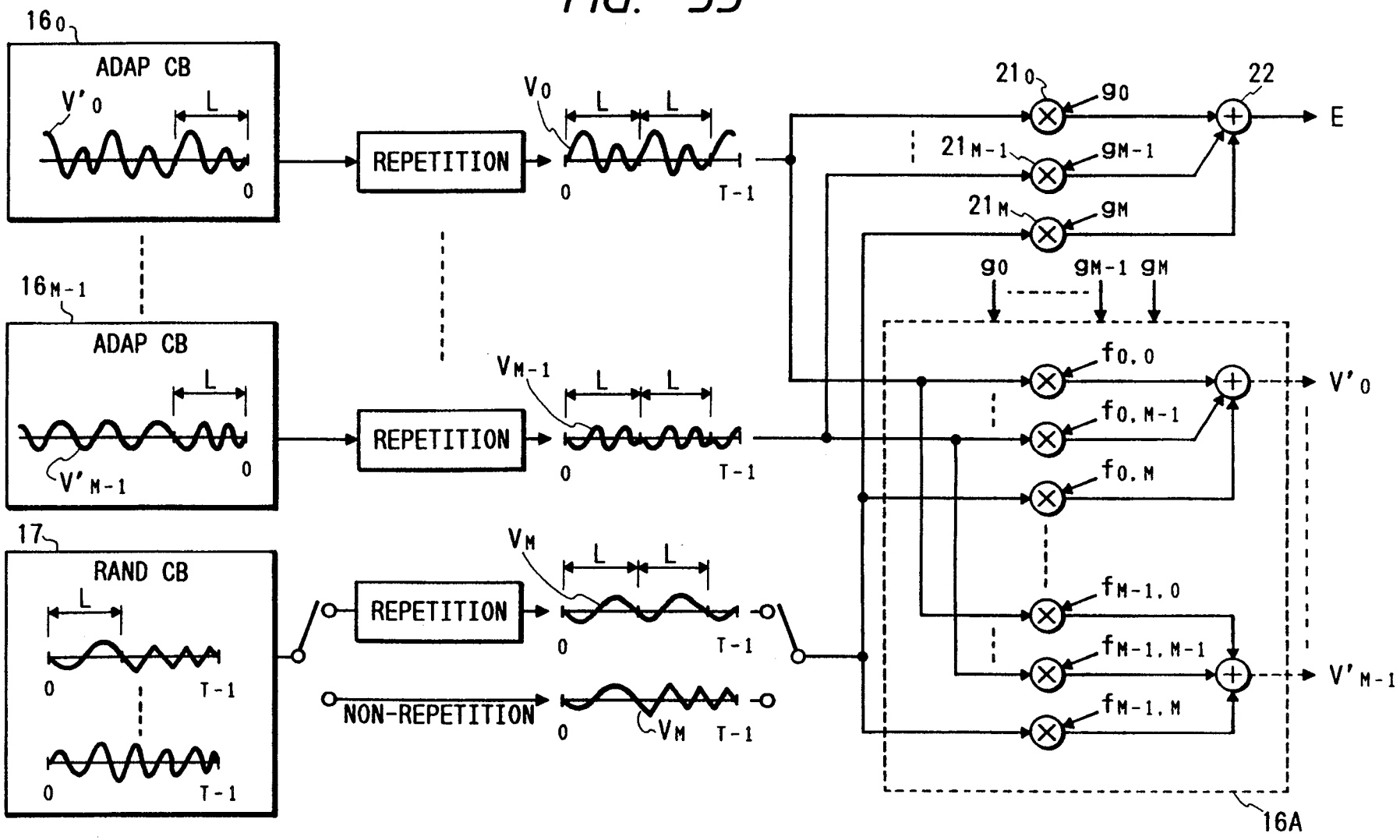
FIG. 33 is a diagram for explaining the update of an adaptive codebook and an excitation signal synthesis in the FIG. 32 embodiment.

FIG. 33 shows the synthesis of the excitation signal E and the updating of each adaptive codebook $\mathbf{16}_i$ in FIG. 32. At first, the excitation signal E is synthesized with $E=\Sigma g_iV_i$ ($\Sigma$ represents summation operation from i=0 to M). Next, in the updating of the adaptive codebook, $V'_i$ is obtained first by the following equation.

$$V'_i=\sum_{i=0}^{M-1} f_{ij}V_i, \ (i=0, \ldots, M-1)$$

where $f_{i,j}$ (i=0, . . . , M−1; j=0, . . . , M) is a weight function for obtaining $V'_i$ from each adaptive codevector $V_i$ (i=0, . . . , M−1) and the random codevector $V_M$. That is, the adaptive codevector $V'_i$ of each adaptive codebook 16$_i$ is the sum of codevectors $f_{i,0}V_0$, $f_{i,1}V_1$, $f_{1,2}V_2$, . . . , $f_{i,M-1}V_{M-1}$ obtained by weighting adaptive codevectors of the previous frame and a codevector $f_{i,M}V_M$ obtained by weighting the random codevector.

In the next frame, the codevector $V'_i$ of the thus updated adaptive codebook is repeated with the pitch period L to the frame length T (assumed to be represented by the waveform sample number), by which the adaptive codevector $V_i$ (i=0, . . . , M−1) is obtained. When L≦T, a signal which goes back by the length L from the terminating end 0 of the codevector $V'_i$ is repeatedly used until the frame length T is reached. When L>T, a signal which comes down from the time point −L by the length T is used intact. As the codevector $V_M$ of the random codebook 17, the codevector $V_M$ of the random codebook is used without being made repetitious, or a signal which repeats the length T from the beginning to the time point L is used.

The coefficient $f_{i,j}$ for obtaining the codevector $V'_i$ is such as depicted in FIG. 34A. By changing this coefficient, the updating method for the adaptive codebooks 16$_0$ to 16$_{M-1}$ can be changed. For example, as shown in FIG. 34B, if $f_{O,0}=g_0$ and $f_{0,M}=g_M$ are set and if the other coefficients are set to $f_{i,j}=0$, then only the adaptive codebook 16$_0$ will operate effectively and is equivalent to the conventional adaptive codebook shown in FIG. 1.

On the other hand, in the case where $f_{0,0}=g_0$, $f_{0,1}=g_1$, $f_{0,M}=g_M$, $f_{i,M}=g_M$, and the others are set to $f_{i,j}=0$, it is only the adaptive codebooks 16$_0$ and 16$_1$ that effectively operate. In this instance, an excitation signal $g_0V_0+g_1V_1+g_MV_M$ of the preceding frame is selected as the updated codevector $V'_0$ of the adaptive codebook 16$_0$, and a signal $g_MV_M$ obtained by multiplying the random codevector of the preceding frame by $g_M$ is selected as the updated codevector $V'_1$ of the adaptive codebook 16$_1$. By this, the component of the random codevector of the preceding frame is emphasized by $V'_1$ in the determination of the excitation signal of the current frame, and consequently, the correlation between the random codevector of the previous frame and the excitation signal can be enhanced. That is, when L>T, the random codevector cannot be made repetitious, but it can be made repetitious by such a method as shown in FIG. 35A.

Further, let it be assumed that $f_{i,i+1}=g_{i+1}$ (i=0, . . . , M−1), and the others are set to $f_{i,j}=0$ as shown in FIG. 35B. In this instance, the random codevector component $V_M$, once updated, appears as $g_MV_M$ in the codevector $V'_{M-1}$, and after being updated next, it appears as $g_{M+1}V_{M-1}$ in the codevector $V'_{M-2}$, and thereafter it similarly appears. Hence, for each updated codevector $V'_1$, one of M random codevectors selected in the previous frames is stored in one adaptive codebook 16$_i$. The excitation signal is synthesized by a weighted sum of adaptive codevectors $V_0$ to $V_{M-1}$ stored in the M adaptive codebooks and the random codevector $V_M$. By providing a plurality of adaptive codebooks in this way, it is possible to implement weighting which is more faithful to the current frame than in the case of employing only one adaptive codebook as in the prior art.

Figure 36:
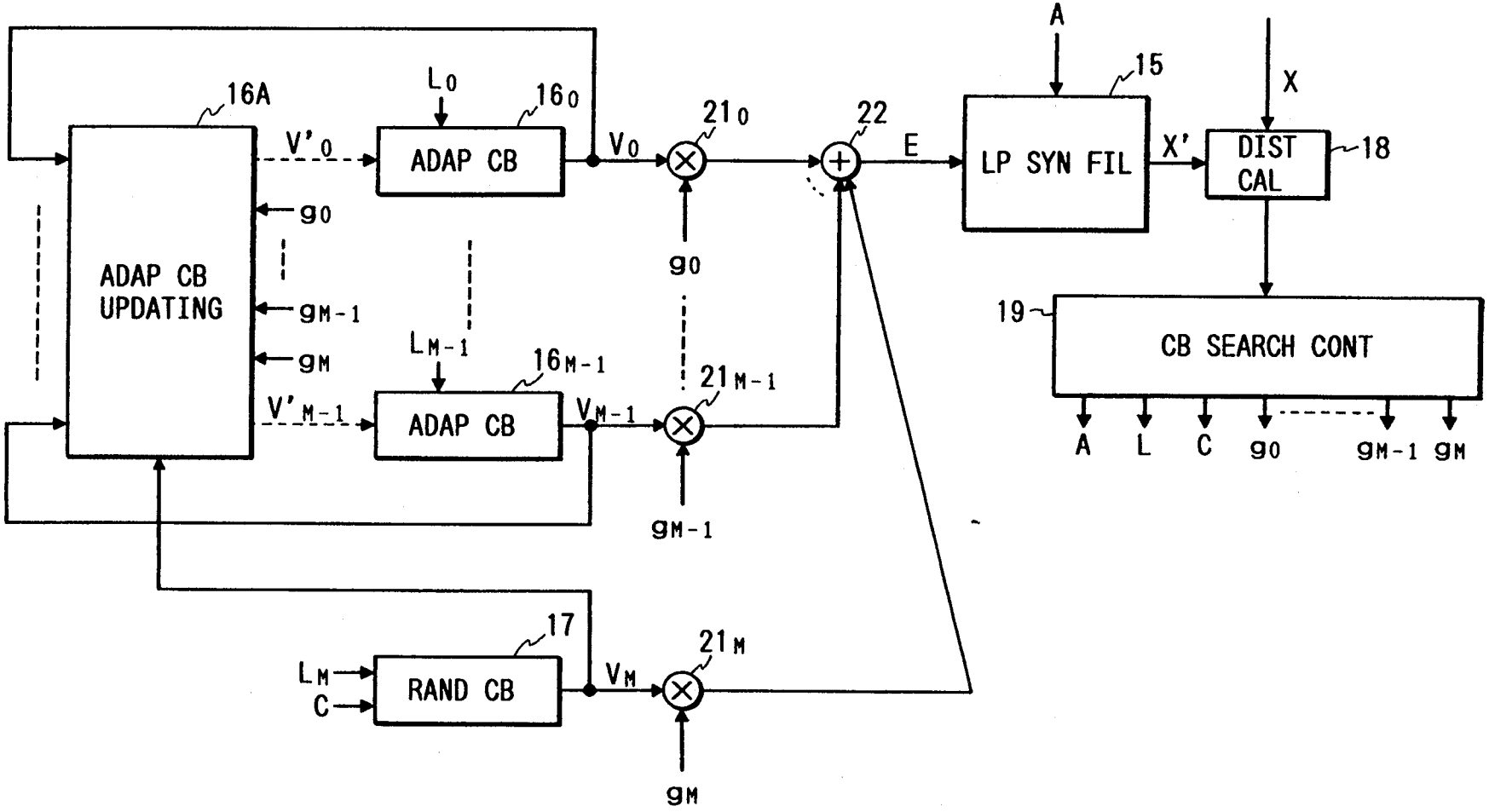
FIG. 36 is a block diagram illustrating a modified form of the ninth embodiment of the present invention.

FIG. 36 illustrates a modified form of the FIG. 32 embodiment, the parts corresponding to those in FIG. 32 being identified by the same reference numerals. The FIG. 32 embodiment uses, as the pitch period L, a value common to every adaptive codebook 16$_i$. In contrast thereto, in the embodiment of FIG. 36 pitch periods $L_0$, . . . , $L_{M-1}$, $L_M$ are allocated to a plurality of adaptive codebooks 16$_0$ to 16$_{M-1}$ and the random codebook 17.

In the actual speech coding, the pitch period is likely to become two-fold or one-half. By preparing a plurality of adaptive codebooks, one of which operates with a pitch twice the pitch period L and the other of which operates with a pitch one-half the period L, and by controlling the weight of each adaptive codevector, it is possible to reconstruct a speech of higher quality. Hence, such different pitch periods are each selected to be substantially an integral multiple of the shortest one of them.

As described above, according to the speech coding methods of embodiments of FIGS. 32 and 36, a plurality of adaptive codebooks are prepared and the excitation signal of the current frame is expressed by a weighted linear sum of a plurality of adaptive codevectors of the adaptive codebooks and the random codevector of the random codebook, and this provides an advantage that it is possible to implement speech coding which is more adaptable and higher quality than the prior art speech coding.

It will be apparent that many modifications and variations may be effected without departing from the scope of the novel concepts of the present invention.

What is claimed is:

1. A speech coding method comprising:

a first step of cutting out a segment of a length of a pitch period from an excitation vector of a previous frame held in adaptive codebook means and repeatedly concatenating said segment of said excitation vector to generate a periodic component codevector;

a second step of reading out a random codevector from random codebook means;

a third step of cutting out a segment of a length corresponding to said pitch period from said read out random codevector, repeatedly concatenating said segment of said read out random codevector to generate a repetitious random codevector, and outputting a random component vector corresponding to said repetitious random codevector;

a fourth step of generating an excitation vector, based on said periodic component vector and said random component vector;

a fifth step of exciting a linear predictive synthesis filter by said excitation vector and calculating distortion of a reconstructed speech output from said filter, relative to an input speech; and a sixth step of searching said pitch period and said random codevector which minimize said distortion to produce a searched pitch period and a searched random codevector to be coded.

2. The speech coding method of claim 1 wherein said second step includes a step of reading out a random codevector to be made repetitious and a random codevector to be held non-repetitious, and said random component vector outputting step includes a step of generating said random component vector by linearly coupling said repetitious random codevector and said non-repetitious random codevector.

3. The speech coding method of claim 2 wherein said random codevector generating step includes a step of multiplying said repetitious random codevector and said non-repetitious random codevector by first and second weights, respectively, and accumulating said weighted random codevectors to obtain said random component vector, and wherein said fourth step includes a step of searching the ratio of said first and second weights for optimum combination of said repetitious and non-repetitious codevector to determine a weight ratio which minimizes said distortion of said reconstructed speech.

4. The speech coding method of claim 1 wherein said sixth step includes a step of: upon each generation of said periodic component codevector in said first step, repeating a sequence of said second, third, fourth and fifth steps for each of a predetermined number of random codevectors which are read out of said random codebook means; and a step of executing said sequence repeating step for each of a predetermined number of pitch periods.

5. The speech coding method of claim 4 wherein said periodic component vector generated in said first step in provided as said excitation vector to said synthesis filter for each of all possible pitch periods, distortion of the resulting reconstructed speech provided from said synthesis filter is calculated for each pitch period, and said predetermined number of pitch periods are preselected in increasing order of distortion of said reconstructed speech.

6. The speech coding method of claim 4 wherein a prediction residual of said input speech is calculated, an auto-correlation of said prediction residual is calculated, a predetermined number of the largest peak values of said auto-correlation in decreasing order of said peak values are selected, and said predetermined number of pitch periods are determined on the basis of delays which provide said selected number of peak values.

7. The speech coding method of claim 4, 5, or 6 wherein, for each of all possible pitch periods, said periodic component codevector generated in said first step is provided as said excitation vector to said synthesis filter, distortion of the resulting reconstructed speech is calculated for each pitch period, the pitch period which provided a minimum distortion of said reconstructed speech is selected and used to execute said sequence of said second, third, fourth and fifth steps for all random codevectors read out of said random codebook means, and said predetermined number of random codevectors are selected on the basis of which provided the smallest distortion of said reconstructed speech.

8. The speech coding method of claim 4, 5, or 6 wherein, for each of all possible pitch periods, said periodic component codevector generated in said first step in provided as said excitation vector to said synthesis filter, distortion of the resulting reconstructed speech is calculated for each pitch period, the pitch period which provided a minimum distortion of said reconstructed speech is selected, correlation values between an error component obtained by removing from said input speech the component of said periodic component codevector which provided said minimum distortion and all of said random codevectors of said random codebook means, and said predetermined number of random codevectors are preselected on the basis of which provided the largest correlation values.

9. The speech coding method of claim 1 wherein said third step is a step of generating a first repetitious random codevector by making said read out random codevector repetitious with said pitch period and generating a second repetitious random codevector by making said read out random codevector repetitious with at least one of periods that are one-half and twice said pitch period and one-half, one time and twice the pitch period of the preceding frame, and outputting said first and second repetitious random code vectors as said random component vectors.

10. The speech coding method of claim 1 wherein said third step is a step of outputting said repetitious random codevector as said random component vector for said random codevector read out from predetermined ones of random codevectors of said random codebook means and outputting said repetitious random codevector as said random component vector for said random codevector read out from the remaining random codevectors of said random codebook means.

11. The speech coding method of claim 1 wherein said third step is a step of generating a first repetitious random codevector by making said selected random codevector repetitious with said pitch period and operating a second repetitious random codevector by making said selected random codevector repetitious with at least one of periods one-half and twice said pitch period and one-half, one time and twice the pitch period of the preceding frame, and outputting a linear combination of said first and second repetitious random codevectors as said random component vector.

12. The speech coding method of claim 1 which further comprising a step of evaluating the periodicity of the current or previous frame of speech, and said third step including a step of adaptive changing the degree of repetitiousness of random codevectors of said random codebook means for each frame in accordance with said periodicity.

13. The speech coding method of claim 12 wherein said degree of repetitiousness is changed by changing the ratio between the number of random codevectors in said random codebook means to be made repetitious and the number of random codevectors in said random codebook means to be held non-repetitious, in accordance with said periodicity of said speech.

14. The speech coding method of claim 12 wherein said degree of repetitiousness is changed by setting the level of the component of said selected random codevector higher or lower as said periodicity of said speech decreases or increases, and adding the component to said repetitious random codevector.

15. The speech coding method of claim 1 further comprising:

a step of analyzing the periodicity of a speech waveform and obtaining a plurality of candidates for a pitch period and the periodicity of each of said candidates;

a step of providing said periodic component codevector, generated in said first step, as said excitation vector to said synthesis filter for each of said plurality of pitch periods and calculating values corresponding to waveform distortions of the resulting reconstructed speeches provided from said synthesis filter; and a step of selecting said period from said plurality of candidates therefor on the basis of said periodicity obtained for each of said candidates and said values corresponding to said waveform distortions.

16. The speech coding method of claim 15 wherein said step of obtaining said candidates for said pitch period and periodicity of said candidates includes a step of calculating an auto-correlation of a linear prediction residual of said input speech, selecting a predetermined number of largest peaks in decreasing order, determining correlation values of the peaks as said periodicity, and determining the periods of peaks which provided said largest correlation values, as said candidates for said pitch period.

17. The speech coding method of claim 16 wherein said step of calculating values corresponding to waveform distortions includes a step wherein, letting said input speech, said pitch period, said periodic component codevector generated in said first step, an impulse response of said synthesis filter and a value corresponding to said waveform distortion be represented by X, $\tau$, $P(\tau)$, H and $e(\tau)$, respectively, said value $e(\tau)$ is expressed by $$e(\tau)=(X^T HP(\tau))^2/HP(\tau)^T HP(\tau),$$

and letting the value of the correlation of each pitch period candidate be represented by $\rho(\tau)$, that one of said pitch period candidates which maximizes $e(\tau)\rho(\tau)$ is determined as said pitch period.

18. A speech coding method in which a speech signal is analyzed by linear prediction in units of frames to obtain predictive coefficients, a weighted sum of vectors from an adaptive codebook having a pitch period component and K random codebooks, K being an integer equal to or greater than 2, is provided as an excitation vector to a synthesis filter of said predictive coefficients to obtain a synthesized speech, and a pitch period, a code of random codevector and a gain are determined which minimize an error between said synthesized speech and an input speech, said method comprising:

a first step of generating from said adaptive codebook a periodic component codevector P which minimizes distortion of said synthesized speech relative to said input speech;

a second step of providing all random codevectors from said K random codebooks each having a plurality of random codevectors $C_{ij}$ and said periodic component codevector P to said synthesis filter to obtain $HC_{ij}$ and HP, i representing the number of each random codebook, $i=0, \ldots, K-1$, j representing the number of each random codevector in an $i^{th}$ one of said random codebooks, $j=0, \ldots, N_i$, $N_i$ being an integer equal to or greater than 2 and representing the number of said random codevectors of said $i^{th}$ random codebook, and H representing an impulse response matrix of said synthesis filter;

a third step of orthogonalizing said $HC_{ij}$ and said HP to obtain a reconstructed vector $U_{ij}$ given by the following equation:

$$U_{ij} = HC_{ij} - \frac{P^T H^T HC_{ij}}{\| HP \|^2} HP$$

where T represents a transposed matrix;

a fourth step of determining, for each of said K random codebooks, a code J(i) of said random codevector which minimizes distortion d of said reconstructed vector relative to an input speech vector X, said distortion being given by the following equation:

$$d = \| X - g \sum_{i=0}^{K-1} U_{ij} \|^2$$

where g represents a gain variable; and a fifth step of weighting said periodic component codevector and a random codevector $C_{ij(i)}$ of said code J(i) with gains $g_0$ and $g_1$, respectively, and adding together the weighted periodic component codevector and the weighted random codevector, calculating, for a plurality of sets of gains $g_0$ and $g_1$, distortion, relative to the input speech vector X, of a synthesized speech which is reconstructed when the result of said accumulation is provided as said excitation vector to said synthesis filter to excite said synthesis filter, said distortion of said synthesized speech vector X relative to said input speech being expressed by $$\| X - \left\{ g_0 HP + g_1 H \left( \sum_{i=0}^{K-1} C_{ij(i)} \right) \right\} \|^2$$

and then determining said set of gains $g_0$ and $g_1$ to be coded which minimizes said distortion of said synthesized speech.

19. The speech coding method of claim 18 wherein said third step includes a step of precalculating $X^T H$, $P^T H^T H$ and $\| HP \|^2$ as constants, respectively, and a step of calculating the following difference vector $\Psi_{ij}$ for said random codevector $C_{ij}$ through use of said precalculated constants:

$$\Psi_{ij} = C_{ij} - \frac{P^T H^T HC_{ij}}{\| HP \|^2} P$$

where $i=0, 1, \ldots, K-1$ and $j=0, 1, \ldots, Ni$, and which further comprises a step of calculating the following inner product $d_{ij}$ for said random codebook of said number i:

$$d_{ij}=X^T H\Omega_{ij},$$

and a step of selecting $n_i$ largest $d_{ij}$ in decreasing order for each number i, and wherein said fourth step includes a step of calculating the following parameter $\Theta$ for a set of numbers (i, j) corresponding to said selected $d_{ij}$:

$$\theta = \left( X^T \sum_{i=0}^{K-1} U_{1j} \right)^2 / | \sum_{i=0}^{K-1} U_{ij} |^2,$$

and determining said set of numbers (i, j) which maximizes said $\Theta$.

20. A speech coding method in which an input speech is analyzed for each frame, an excitation signal composed of a weighted linear sum of a periodic component codevector of an adaptive codebook and a random codevector of a random codebook is applied to a linear predictive synthesis filter to synthesize a speech, and codevectors are selected so that distortion of said synthesized speech relative to said input speech is minimized, said method comprising:

generating from a plurality of adaptive codebooks periodic component codevectors rendered repetitious with respective periods;

updating said periodic component codevector of each of said adaptive codebooks with a weighted linear sum of said plurality of periodic component codevectors and said random codevector from said random codebook; and generating said excitation signal of the current frame with a new weighted linear sum of said updated periodic component codevectors of said plurality of adaptive codebooks and said random codevector of said random codebook.

21. The speech coding method of claim 20 wherein at least one of said plurality of adaptive codebooks has a pitch period repeating period different from those of the other adaptive codebooks.

22. A speech coding method in which a speech is reconstructed by driving a linear predictive synthesis filter with a periodic component codevector generated from an adaptive codebook through use of a selected pitch period and a random codevector output from a random codebook, and an input speech is coded for each frame by use of said periodic component codevector and said random codevector so that distortion of said reconstructed speech relative to said input speech is minimized, said method comprising:

generating a periodic component codevector of an optimum pitch period for said input speech vector on the basis of said excitation vector of the previous frame held in said adaptive codebook;

multiplying said periodic component codevector by m predetermined window functions to obtain m envelope vectors, multiplying said envelope vectors by m weight elements of weight vectors selected from a weight codebook, and outputting the sum of the results of said multiplications as said periodic component codevector, m being an integer equal to or greater than 2; and exciting said synthesis filter with said periodic component codevector, searching said weight codebook for a weight vector which minimizes distortion of said reconstructed speech from said synthesis filter relative to said input speech, and determining a weight parameter representing said weight vector.

23. A speech coding method in which a speech is reconstructed by driving a linear predictive synthesis filter with a periodic component codevector generated from an adaptive codebook through use of a selected pitch period and a random codevector generated from a random codebook and an input speech is coded for each frame by use of said periodic component codevector and said random codevector so that distortion of said reconstructed speech relative to said input speech is minimized, said method comprising:

multiplying said random codevector by m predetermined window functions to obtain m envelope vectors, multiplying said envelope vectors by m weight elements of weight vectors read out from a weight codebook, and outputting the sum of the results of said multiplication as said random codevector, m being an integer equal to or greater than 2; and searching said weight codebook for a weight vector which minimizes distortion of said reconstructed speech from said synthesis filter relative to said input speech, and determining a weight code representing said weight vector.

24. A speech decoding method in which a speech is reconstructed by exciting a linear predictive filter with an excitation vector obtained by combining a periodic component codevector generated from an adaptive codebook on the basis of a given period code and a random codevector output from a random codebook on the basis of a given random code, said method comprising:

cutting out an excitation vector of the previous frame in accordance with said period code and repeatedly concatenating said cut-out excitation vector to generate a periodic component codevector;

reading out from said random codebook a random codevector corresponding to a random code, generating a repetitious random codevector by repeating a vector segment cut out with a pitch period corresponding to said period code, and outputting a repetitious random component vector corresponding to said repetitious random codevector;

generating an excitation vector by linearly combining said periodic component vector and said repetitious random component vector; and synthesizing a speech by exciting said linear predictive synthesis filter with said generated excitation vector.

25. The speech decoding method of claim 24 wherein said repetitious random component vector outputting step includes a step of generating said repetitious random component vector by linearly combining said repetitious random codevector generating non-repetitious random codevector.

26. The speech decoding method of claim 24 wherein said repetitious random component vector outputting step includes a step of generating a first repetitious random codevector by making said random codevector from said random codebook repetitious with said pitch period, generating a second repetitious random codevector by making aid random codevector repetitious with at least one of periods one-half and twice said pitch period and one-half, one time and twice the pitch period of said previous frame, and outputting a linear combination of said first and second repetitious random codevectors as said random component vector.

27. The speech decoding method of claim 24 which further comprises evaluating the periodicity of said reconstructed speech of the current or previous frame, and wherein said random component vector outputting step includes a step of adaptively changing the degree of repetitiousness of said random codevector of said random codebook for each frame in accordance with said periodicity of said reconstructed speech.

* * * * *